US008976126B2

(12) United States Patent
Kim et al.

(10) Patent No.: US 8,976,126 B2
(45) Date of Patent: Mar. 10, 2015

(54) WASHING MACHINE AND METHOD OF CONTROLLING THE SAME

(75) Inventors: Sun Ae Kim, Seoul (KR); Evelyn Wang, San Francisco, CA (US); Soo Hyun Lee, Goyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 278 days.

(21) Appl. No.: 13/137,480

(22) Filed: Aug. 19, 2011

(65) Prior Publication Data

US 2012/0056827 A1 Mar. 8, 2012

Related U.S. Application Data

(60) Provisional application No. 61/379,506, filed on Sep. 2, 2010.

(30) Foreign Application Priority Data

Dec. 29, 2010 (KR) ..... 10-2010-138020

(51) Int. Cl.
*G06F 3/041* (2006.01)
*D06F 39/00* (2006.01)
*D06F 33/02* (2006.01)

(52) U.S. Cl.
CPC ..... *D06F 39/005* (2013.01); *D06F 33/02* (2013.01)
USPC ..... 345/173; 68/3 R

(58) Field of Classification Search
None
See application file for complete search history.

(56) References Cited

U.S. PATENT DOCUMENTS

| | | | | |
|---|---|---|---|---|
| 4,455,653 | A * | 6/1984 | Le Gars et al. | 714/48 |
| 5,388,299 | A * | 2/1995 | Lee | 8/159 |
| 6,742,209 | B2 * | 6/2004 | Jeon | 8/159 |
| 2002/0040505 | A1 * | 4/2002 | Tanaka et al. | 8/158 |
| 2002/0046429 | A1 | 4/2002 | Jeon | |
| 2002/0095483 | A1 * | 7/2002 | Lee et al. | 709/219 |
| 2002/0099960 | A1 * | 7/2002 | Klein | 713/202 |
| 2006/0097993 | A1 * | 5/2006 | Hietala et al. | 345/173 |
| 2007/0123177 | A1 * | 5/2007 | Jeong et al. | 455/90.1 |
| 2008/0062140 | A1 * | 3/2008 | Hotelling et al. | 345/173 |
| 2009/0007346 | A1 * | 1/2009 | Ha et al. | 8/159 |
| 2009/0010477 | A1 * | 1/2009 | Frobisher | 381/386 |
| 2009/0113638 | A1 * | 5/2009 | Kim et al. | 8/158 |
| 2011/0025924 | A1 * | 2/2011 | Price et al. | 348/734 |
| 2011/0072378 | A1 * | 3/2011 | Nurminen et al. | 715/771 |
| 2012/0330442 | A1 * | 12/2012 | Hwang et al. | 700/90 |

FOREIGN PATENT DOCUMENTS

| | | | |
|---|---|---|---|
| KR | 10-2010-0084111 | * | 7/2010 |
| WO | WO 2010/057827 A1 | * | 5/2010 |

OTHER PUBLICATIONS

Chinese Office Action issued Sep. 29, 2014 in corresponding Chinese Patent Application No. 201110263641.2, 8 pages.

* cited by examiner

*Primary Examiner* — Seokyun Moon
(74) *Attorney, Agent, or Firm* — Staas & Halsey LLP

(57) ABSTRACT

A washing machine to provide a user interface environment using a full-touch LCD to perform communication over a network and a method of controlling the same. It is possible to provide a user interface by simple and convenient touch manipulation and display information regarding a user manipulation state and an operation state of the washing machine according to various visual/tactile tastes.

7 Claims, 65 Drawing Sheets

FIG. 31

30

Wireless Network Setup

Your wifi network set up is complete.

✓ mywifi1

< Back Cancel Setup Continue

FIG. 44

30

Return

Energy and Water Usage

*Press column titles to sort

Usage History

Wash Program Profiles

Energy Saving Tips

| Energy (KwH) | Wash Cycle | Water (liters) | Wash Time |
|---|---|---|---|
| | Baby Care | | 0:48 |
| | Colour | | 0:59 |
| | Cotton | | 0:38 |
| | Daily Wash | | 0:50 |
| | Dark Garment | | 1:08 |
| | Denim | | 0:45 |
| | ECO Wash | | 0:59 |
| | Hand Wash | | 0:48 |
| | Outdoor Care | | 0:59 |
| | Rinse & Spin | | 0:38 |
| | Spin Load | | 0:50 |
| | Synthetics | | 1:08 |
| | White | | 0:45 |
| | Wool | | 0:59 |

FIG. 50

30

Return Stain Guide

Here is your stain fighting tip for:

Red wine on cotton fabric

Always read the label and follow any directions first.

1. Read your clothing label for specific instructions.
2. Use cold water prevent the stain from setting.
3. Use a wash cycle with the warmest water safe for the garment.
3. Hang your garmet to a air dry.
4. Repeat if necessary to remove the stain before using your electric dryer Recommendation Temperature : 30°c
Rinse : 1X
Spin : 400 rpm
Wash Options : Quick Wash Start washing other's experience.

Connect

30

22 [illegible]

The fruit has been donated to Abanobi living in Somalia.
The following is the message from Abanobi:

Hi, Maria
I have been studying very hard with the pencils and note book you have sent me. Thank you very much for your support.

25. Nov. 2010

Sincerely, Abanobi

WASHING MACHINE AND METHOD OF CONTROLLING THE SAME

CROSS-REFERENCE TO RELATED APPLICATIONS

This application claims the benefit of Provisional U.S. Application Ser. No. 61/379,506, filed on Sep. 2, 2010 and Korean Patent Application No. 2010-138020, filed on Dec. 29, 2010 in the Korean Intellectual Property Office, the disclosures of which are incorporated herein by reference.

BACKGROUND

1. Field

Embodiments of the present disclosure relate to a washing machine to provide a user interface environment using a full-touch Liquid Crystal Display (LCD) to perform communication over a network and a method of controlling the same.

2. Description of the Related Art

In general, a washing machine (generally, a drum type washing machine) includes a tub to contain water (wash water or rinsing water), a drum rotatably mounted in the tub to contain laundry, and a motor to generate driving force to rotate the drum, and washes the laundry by raising and dropping the laundry in the drum along the inner wall of the drum when the cylindrical drum is rotated.

In such a washing machine, a plurality of wash courses, programmed by adequately setting wash conditions including wash, rinse and spin times according to laundry weight, is previously stored in a memory. When a user selects a desired wash course, an optimal wash cycle corresponding to the selected wash course is performed.

In order to enable the user to select such a wash course, the washing machine includes a display to display the wash courses. In addition, an input unit (key panel) to input a wash course and a command to operate the washing machine is provided such that the user conveniently selects a desired wash course and wash conditions.

However, although washing machines slightly differ in functions according to manufacturers, since most washing machines provide predetermined wash programs (wash courses) regardless of user taste or preference, a user who wants a new function needs to replace an old washing machine with a new washing machine having the new function or download a new wash program. However, even when the new wash program is downloaded, it may be necessary to replace the existing key panel with a new key panel if a new function may not be performed by the existing key panel.

In addition, in the existing washing machine, since it is difficult for a user to recognize information regarding various states of the washing machine only using a display, the user needs to observe a wash cycle or pause a wash cycle and directly check the state of the machine.

SUMMARY

Therefore, it is an aspect of the present disclosure to provide a washing machine to provide a user interface environment using a full-touch liquid crystal display (LCD) to perform communication over a network and to display information regarding various states of the washing machine and a method of controlling the same.

Additional aspects of the disclosure will be set forth in part in the description which follows and, in part, will be apparent from the description, or may be learned by practice of the disclosure.

In accordance with one aspect of the present disclosure, there is provided a method of controlling a washing machine including a full-touch Liquid Crystal Display (LCD) to perform communication over a network, including displaying real-time weather information by performing communication over the network, recommending a wash program according to the real-time weather information, and displaying basic wash information and energy usage of the wash program.

The basic wash information may include a washing water temperature, a rinse number, spin RPM information and wash time information of the wash program.

The method may further include changing a color of a display screen according to the energy usage of the wash program.

The method may further include displaying a progress state of the wash program according to user touch input.

The method may further include gradating the color of the display screen according to the energy usage while the wash program is performed.

A time and RPM of the wash program may be changed according to the energy usage while the wash program is performed.

The color may include blue, green and red.

The method may further include displaying an energy and water usage history, and recommending a wash program according to the energy and water usage history.

The method may further include displaying the amount of energy and water saved after performing the wash program recommended according to the energy and water usage history.

The method may further include providing laundry stain removal information by performing communication over the network.

The providing the laundry stain removal information may include selecting laundry and a stain category, and displaying a recommended wash program according to the selected laundry and stain category.

The method may further include inputting a product number of the laundry, and displaying a stain treatment method recommended by a manufacturer by performing communication over the network.

The method may further include operating the full-touch LCD in a screen saver mode depending on whether or not a user approaches the washing machine.

In accordance with another aspect of the present disclosure, there is provided a method of controlling a washing machine including a full-touch Liquid Crystal Display (LCD) to perform communication over a network, including selecting a wash program through user touch input, displaying real-time weather information by performing communication over the network, determining whether the selected wash program suits the real-time weather information, and displaying a message recommending that the wash program be changed if the selected wash program does not suit the real-time weather information.

The selecting the wash program may include scrolling through a menu of the wash program and searching wash programs, and touching and selecting a desired wash program from among the searched wash programs.

When the menu of the wash program is scrolled, basic wash information and energy usage of the wash program may be displayed.

The wash program may include ECO, Outdoor Care, Baby Care, Wool, Hand Wash, Spin, Rinse+Spin, Cotton, Synthetics, Denim, Bedding, Dark Garment and Daily Wash.

The method may further include displaying wash options according to the real-time weather information.

The wash options may include Bubble Wash, Easy Iron, Delayed Wash, Pre Wash, Intense Wash, Quick Wash and Dry.

When a dry option function is selected, a dry windy screen may be displayed.

The method may further include performing the wash program if the selected wash program suits the real-time weather information, and displaying a progress state of the wash program.

The method may further include gradating a color of a display screen according to energy usage of the wash program while the wash program is performed.

In accordance with another aspect of the present disclosure, there is provided a washing machine including a full-touch Liquid Crystal Display (LCD) to display information regarding various states of the washing machine through user touch input, a controller to control a wash program according to touch information input through the full-touch LCD, and a communication unit to perform network communication so as to display a variety of information associated with the wash program using the full-touch LCD.

The full-touch LCD may receive and display real-time weather information using the communication unit.

The controller may recommend a wash program according to the real-time weather information and display the wash program using the full-touch LCD.

The full-touch LCD may display basic wash information and energy usage of the wash program.

The full-touch LCD may change a color of a display screen according to the energy usage of the wash program.

The full-touch LCD may display an energy and water usage history, and the controller may recommend a wash program according to the energy and water usage history and display the wash program using the full-touch LCD.

The full-touch LCD may display a progress state of the wash program.

The full-touch LCD may receive and display laundry stain removal information through the communication unit.

The washing machine may further include a sensor to sense whether or not a user approaches the washing machine, and the controller may operate the full-touch LCD according to information sensed by the sensor.

The washing machine may further include a sound output unit to audibly output a progress state of the wash program.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 31 is a diagram showing a network setup completion screen in a full-touch LCD according to an embodiment of the present disclosure;

FIG. 44 is a diagram showing a wash program profile of energy and water usage in a full-touch LCD according to an embodiment of the present disclosure;

FIG. 50 is a diagram showing a guide screen to remove stains from laundry in a full-touch LCD according to an embodiment of the present disclosure;

DETAILED DESCRIPTION

Figure 1:
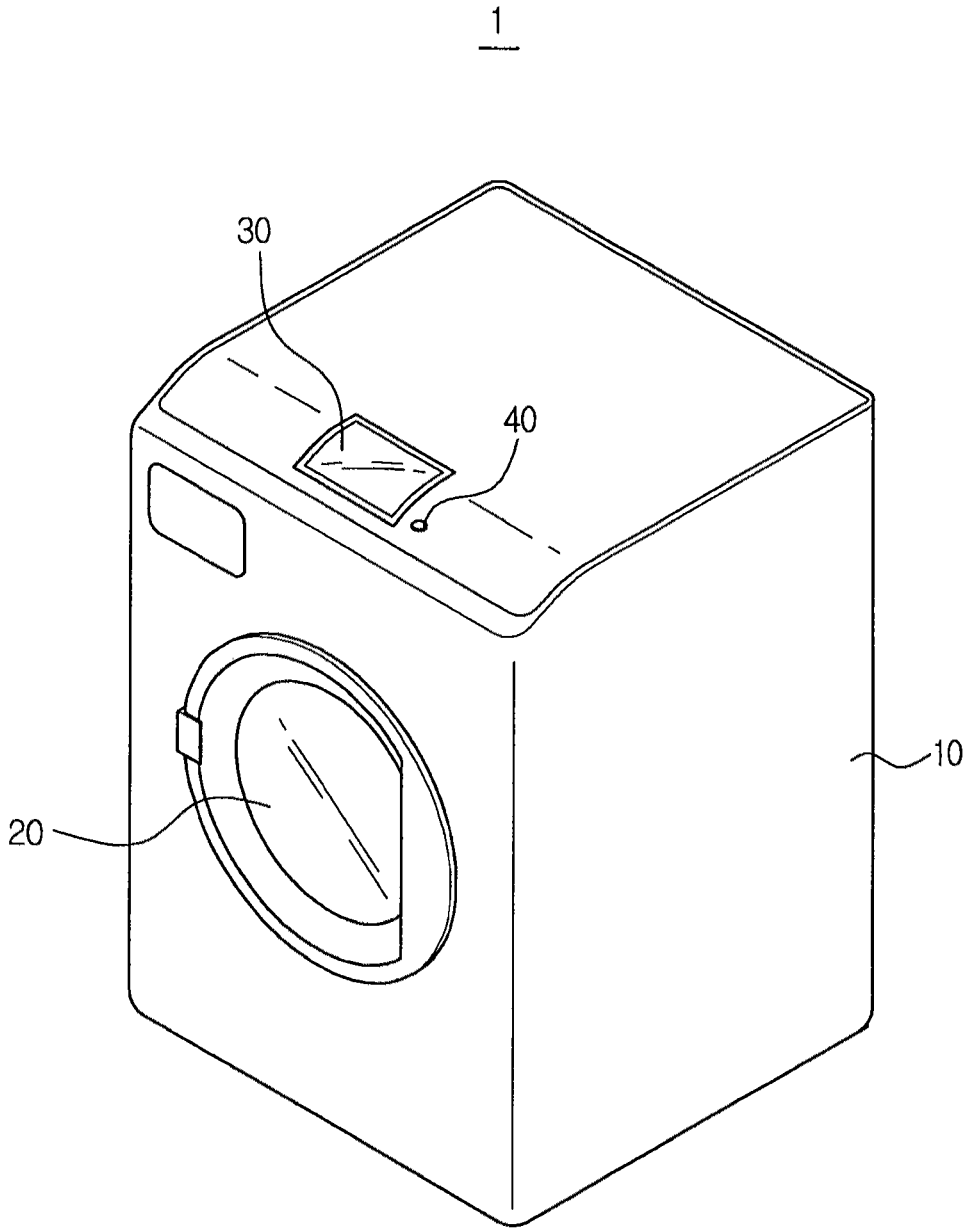
FIG. 1 is a perspective showing the appearance of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a perspective view showing the configuration of a washing machine according to an embodiment of the present disclosure.

In FIG. 1, the washing machine 1 according to the embodiment of the present disclosure includes a main body 10 substantially having a box shape and forming the appearance thereof, a door 20 provided in a front surface of the main body 10 to insert laundry therethrough; a full-touch LCD 30 provided on an upper surface of the main body 10 to provide an interface to a user and to display information regarding various states of the washing machine 1 using graphics, icons, figures or characters.

A power key 40 to power the full-touch LCD 30 on or off is provided on the right side of the full-touch LCD 30.

The full-touch LCD 30 serves as a user interface to control a wash program (wash course) and an operation of the washing machine 1 by simple and convenient touch manipulation and displays a user manipulation state and an operation state of the washing machine 1.

The full-touch LCD 30 is a 7-inch touchscreen which may be connected to a network and provides real-time weather information and a Social Network Service (SNS) through the Android™ operating system (OS). Thus, the full-touch LCD 30 may provide a recommended wash program based on weather, an email for donation of saved energy and online laundry stain removal information.

The full-touch LCD 30 selects a smart grid so as to not only recommend a wash program based on real-time weather information but also to provide information regarding change in wash time and RPM or information regarding delay of a wash time according to power consumption.

The full-touch LCD 30 may provide a Graphical User Interface (GUI) theme by setting a background screen to a soft color (blue, green or red), thereby providing an emotive display.

Although the power key 40 is separately mounted on the right side of the full-touch LCD 30 in the embodiment of the present disclosure, the present disclosure is not limited thereto and a power key 40 may be included in the full-touch LCD 30. As another example, the full-touch LCD 30 may include a touch sensor such that the full-touch LCD 30 is powered on when a user touches the screen of the full-touch LCD 30. As another example, the full-touch LCD 30 may include a proximity sensor such that the full-touch LCD 30 is automatically powered on when a user approaches the washing machine 1.

When the user touches the power key 40 or the screen of the full-touch LCD 30, power is supplied to the full-touch LCD 30 such that a predetermined main screen is displayed on the full-touch LCD 30.

Figure 2:
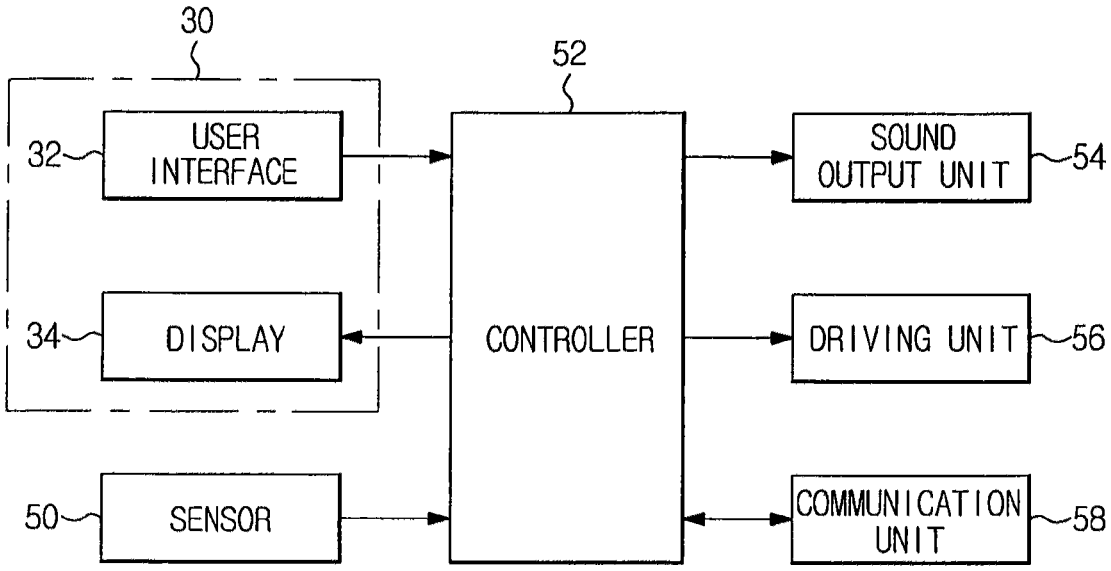
FIG. 2 is a block diagram showing the configuration of a washing machine according to an embodiment of the present disclosure.

FIG. 2 is a block diagram showing the configuration of a washing machine according to an embodiment of the present disclosure, which includes a user interface 32, a display 34, a sensor 50, a controller 52, a sound output unit 54, a driving unit 56 and a communication unit 58.

The user interface 32 and the display 34 configure the full-touch LCD 30.

The user interface 32 serves to input various operation commands to control a wash program (wash course) and the washing machine 1 by simple and convenient key touch manipulation.

The display 34 recognizes touch information input through the user interface 32 and displays a user manipulation state and the operation state of the washing machine 1.

The sensor 50 receives a variety of sensor information associated with the operation of the washing machine 1, senses whether or not a user approaches the washing machine 1, and transmits the sensed result to the controller 52.

The controller 52 is a microcomputer to control the overall operation of the washing machine 1, such as wash, rinse and spin, according to touch information input through the user interface 32. The controller controls various loads (e.g., a motor, a valve, etc.) through the driving unit 56, performs a wash program (wash course) and displays a progress of the wash program on the display 34.

The controller 52 receives sensor information from the sensor 50 and supplies power to the full-touch LCD 30 such that the full-touch LCD 30 is automatically powered on.

The sound output unit 54 audibly outputs various states associated with the operation of the washing machine 1 and the progress of the wash program according to a sound control signal of the controller 52.

The driving unit 58 drives various loads (a motor, a valve, etc.) so as to perform the wash program associated with washing according to a driving control signal of the controller 52.

The communication unit 58 receives a variety of information (e.g., laundry stain removal tips, a stain treatment method, etc.) associated with wash from various external devices (a computer, a manufacturer, etc.) and performs communication over a network (Internet) between the washing machine 1 and an external device so as to display the information on the full-touch LCD 30.

Figure 3:
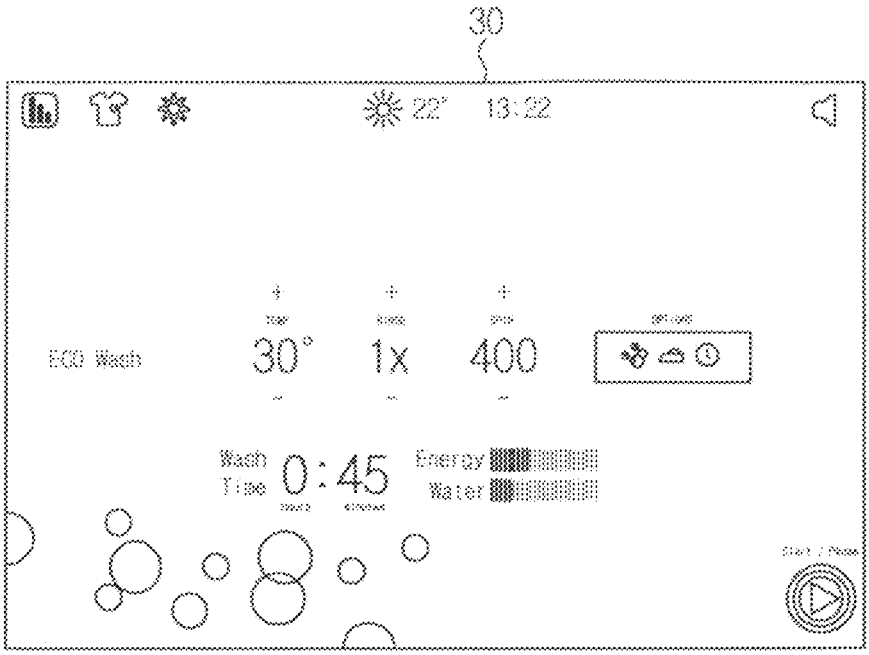
FIG. 3 is a diagram showing an example of a main screen of a full-touch LCD according to an embodiment of the present disclosure.

FIG. 3 is a diagram showing an example of a main screen of a full-touch LCD according to an embodiment of the present disclosure, which shows a European screen layout.

In FIG. 3, the full-touch LCD 30 displays basic wash information such as a wash program (e.g., ECO wash), a wash water temperature TEMP (e.g., 30°), a rinse number RINSE (e.g., 1×), a spin RPM SPIN (e.g., 400) on the central portion of the front surface thereof. Change keys + and − to change information are provided above and below the basic wash information displayed on the central portion of the front surface of the full-touch LCD.

The full-touch LCD 30 displays option information such as bubble wash, delayed wash or easy iron using icons.

Wash time (e.g., 0:45) consumed to perform the wash program (e.g., ECO wash) is displayed on the central portion of the front surface of the full-touch LCD 30 using figures and the amount of energy and water consumed when performing the wash program (e.g., ECO wash) is displayed on the right side of the wash time as a bar-shaped icon.

Current time information (1:13 PM) and weather information (22° and sunny) are displayed on an upper end of the central portion of the full-touch LCD 30, selection icons such as a stain guide, energy and water usage and system settings are displayed on the upper end of the left side of the full-touch LCD 30, and a sound output icon is displayed on the upper end of the right side of the full-touch LCD 30.

A start/pause key to start or pause the operation of the washing machine 1 is provided on the lower end of the right side of the full-touch LCD 30.

Although the start/pause key is provided on the lower end of the right side of the full-touch LCD 30 in the embodiment of the present disclosure, the embodiments of the present are not limited thereto and the start/pause key may be provided on the lower end of the central portion of the full-touch LCD 30 and the location thereof may be variously changed as necessary.

In addition, a message associated with the operation of the washing machine 1 or an error message (e.g., "water level sensor problem") may be displayed on the upper end of the central portion of the full-touch LCD 30.

If the lower end of the left side of the full-touch LCD 30 is touched, the screen may be switched to a daily wash screen which is a default screen.

The full-touch LCD 30 provides three colors such as blue, green and red according to energy usage of a wash program.

Bubble is displayed on the lower end of the full-touch LCD 30 in the form of animation. If the user touches a bubble image, bubbles are generated so as to provide visual/tactile pleasure to the user.

Figure 4:
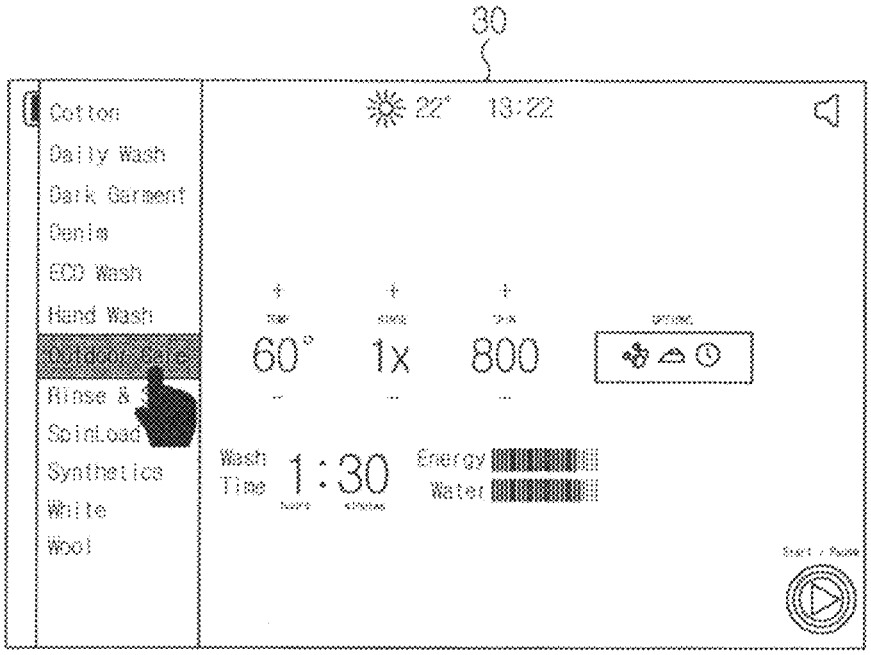
FIG. 4 is a first diagram showing a screen to select a wash program in a full-touch LCD according to an embodiment of the present disclosure.

FIG. 4 is a first diagram showing a screen to select a wash program in a full-touch LCD according to an embodiment of the present disclosure.

In FIG. 4, when the user touches a field of the wash program, selectable wash programs (Eco, Outdoor Care, Baby Care, Wool, Hand Wash, Spin, Rinse+Spin, Cotton, Synthetics, Denim, Bedding, Dark Garment, Daily Wash, Drum Clean, etc.) are displayed as a pop-up menu.

Then, the user scrolls through the pop-up menu of the wash program in order to select a desired wash program from among the wash programs (Eco, Outdoor Care, Baby Care, Wool, Hand Wash, Spin, Rinse+Spin, Cotton, Synthetics, Denim, Bedding, Dark Garment, Daily Wash, Drum Clean, etc.) displayed as the pop-up menu.

If the is "Outdoor Care" wash program is selected, basic wash information such as a wash water temperature TEMP (e.g., 60°), a rinse number RINSE (e.g., 3×), a spin RPM SPIN (e.g., 800) is displayed on the full-touch LCD 30.

A wash time (e.g., 1:30), energy usage and water consumption required for the wash program (Outdoor Care) are displayed below the basic wash information displayed on the full-touch LCD 30.

Figure 5:
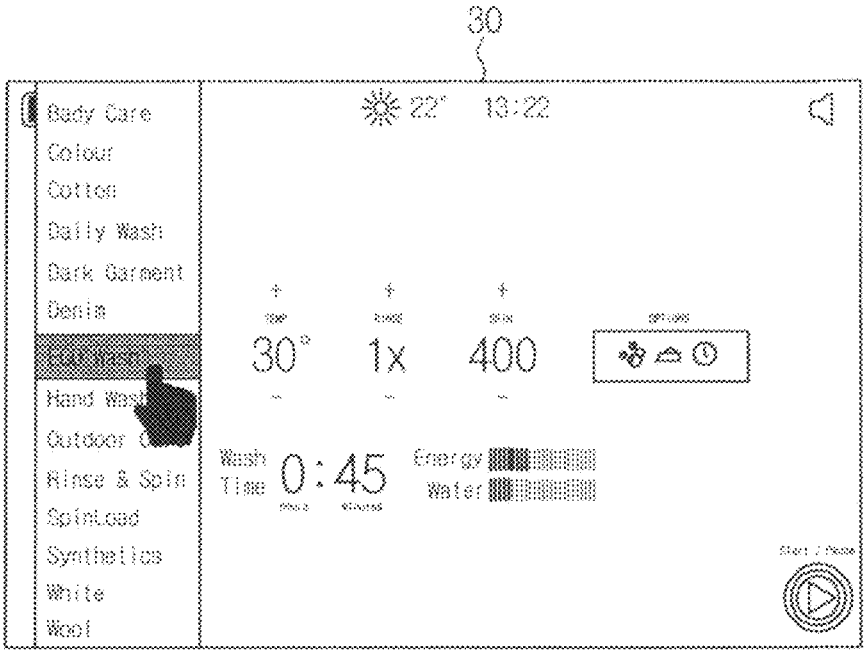
FIG. 5 is a second diagram showing a screen to select a wash program in a full-touch LCD according to an embodiment of the present disclosure.

FIG. 5 is a second diagram showing a screen to select a wash program in a full-touch LCD according to an embodiment of the present disclosure.

In FIG. 5, if the "Eco Wash" wash program is selected, basic wash information such as a wash water temperature TEMP (e.g., 30°), a rinse number RINSE (e.g., 1×) and a spin RPM SPIN (e.g., 400) is displayed on the full-touch LCD 30.

A wash time (e.g., 0:45), energy usage and water consumption required for the wash program (Eco Wash) are displayed below the basic wash information displayed on the full-touch LCD 30.

When the user selects the wash program "Eco Wash" from among the wash programs, basic wash information such as a wash water temperature TEMP (e.g., 30°), a rinse number RINSE (e.g., 1×) and a spin RPM SPIN (e.g., 400) is displayed on the central portion of the full-touch LCD 30.

The user may change the basic wash information (the wash water temperature, the rinse number, and the spin RPM) using the change keys + an − provided above and below the basic wash information displayed on the full-touch LCD 30, which will be described with reference to FIGS. 6 and 7.

Figure 6:
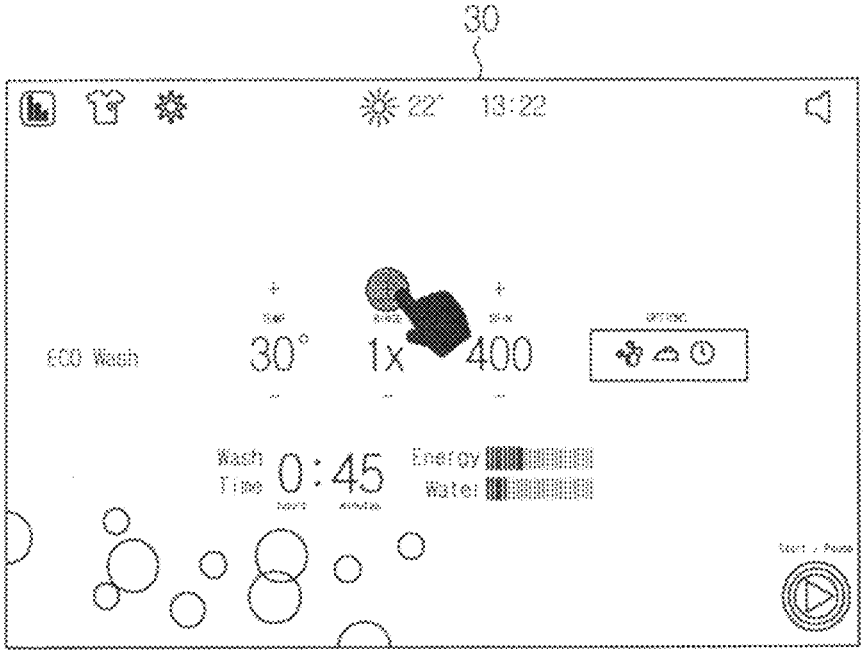
FIG. 6 is a diagram showing an example of a screen to change information regarding a wash program in a full-touch LCD according to an embodiment of the present disclosure.

FIG. 6 is a diagram showing an example of a screen to change information regarding a wash program in a full-touch LCD according to an embodiment of the present disclosure.

Figure 7:
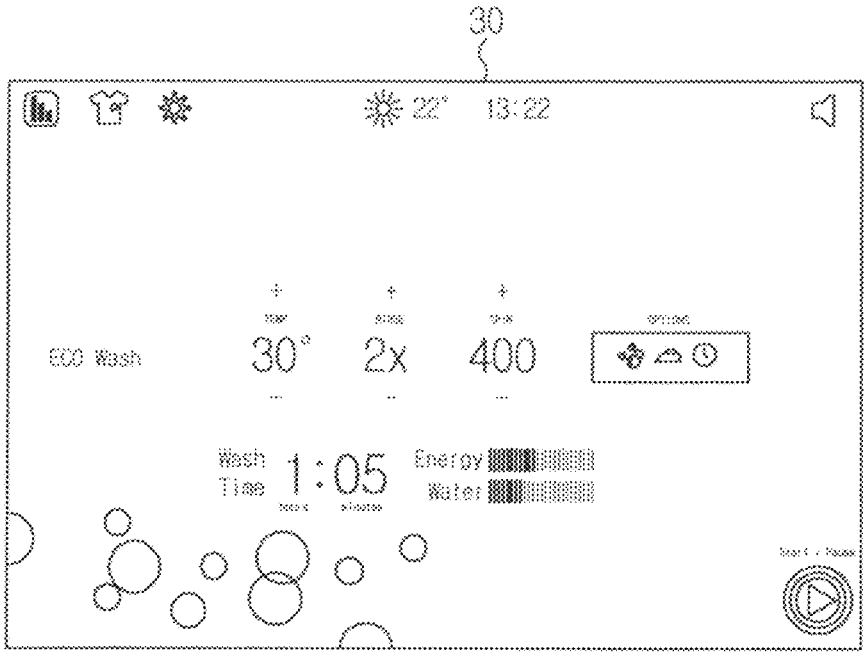
FIG. 7 is a diagram showing a screen to display changed information of a wash program in a full-touch LCD according to an embodiment of the present disclosure.

In FIG. 6, when the user touches the change key + provided above the rinse number information RINSE (e.g., 1×), the screen of the full-touch LCD 30 is switched to the screen shown in FIG. 7.

FIG. 7 is a diagram showing a screen to display changed information of a wash program in a full-touch LCD according to an embodiment of the present disclosure.

In FIG. 7, it can be seen that the wash time is also changed to 1:05 as the rinse number information RINSE is changed to "2×" (two times) by touching the change key +.

In this way, the rinse number information RINSE may be changed from "1×" (one time) to "5×" (five times) by touching the change keys + and −.

The user may variously change the wash water temperature TEMP (e.g., 30°, 40°, 60°, 95°, etc.) by touching the change keys + and − provided above and below the wash water temperature information TEMP.

In addition, the user may variously change the spin RPM SPIN (e.g., 300, 400, 800, 1200, etc.) by touching the change keys + and − provided above and below the spin RPM SPIN.

Figure 8:
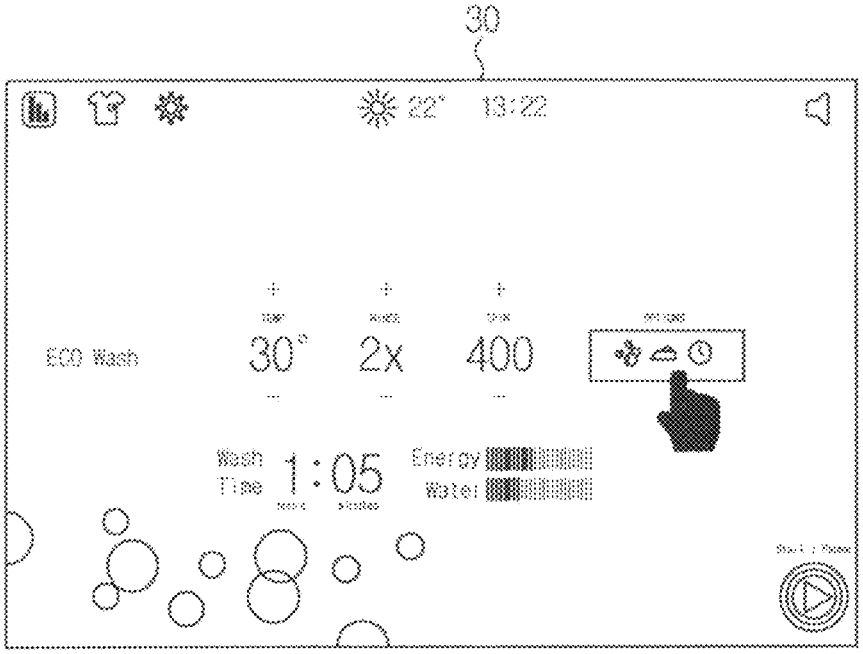
FIG. 8 is a diagram showing a screen to select options of a wash program in a full-touch LCD according to an embodiment of the present disclosure.

FIG. 8 is a diagram showing a screen to select options of a wash program in a full-touch LCD according to an embodiment of the present disclosure. The case where option information is selected on the screen to display the changed information of the wash program in FIG. 7 will be described.

Figure 9:
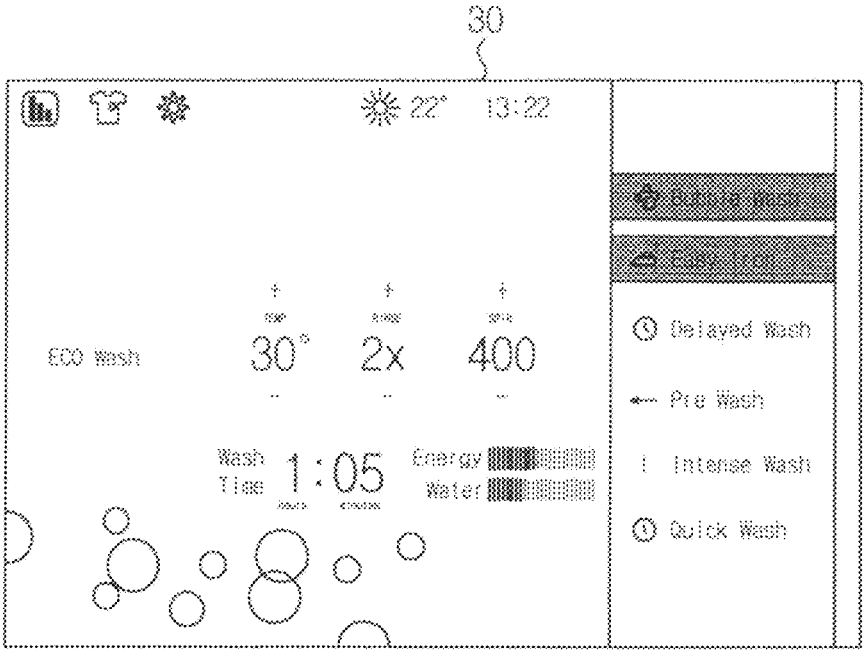
FIG. 9 is a diagram showing a screen to select option information of a wash program in a full-touch LCD according to an embodiment of the present disclosure.

In FIG. 8, when the user touches an option key OPTIONS provided on the right side of the central portion of the full-touch LCD 30, selectable wash options are displayed as a pop-up menu as shown in FIG. 9.

FIG. 9 is a diagram showing a screen to select option information of a wash program in a full-touch LCD according to an embodiment of the present disclosure.

In FIG. 9, icons for Bubble Wash, Easy Iron, Delayed Wash, Pre Wash, Intense Wash, Quick Wash may be provided as wash options and information corresponding to the options for Bubble Wash, Easy Iron, Delayed Wash, Pre Wash, Intense Wash and Quick Wash may be displayed. Therefore, the user may select a desired wash option from among the wash options such as Bubble Wash, Easy Iron, Delayed Wash, Pre Wash, Intense Wash and Quick Wash.

When the user selects Delayed Wash from among the wash options shown in FIG. 9, a time may be set, which will be described with reference to FIG. 10.

Figure 10:
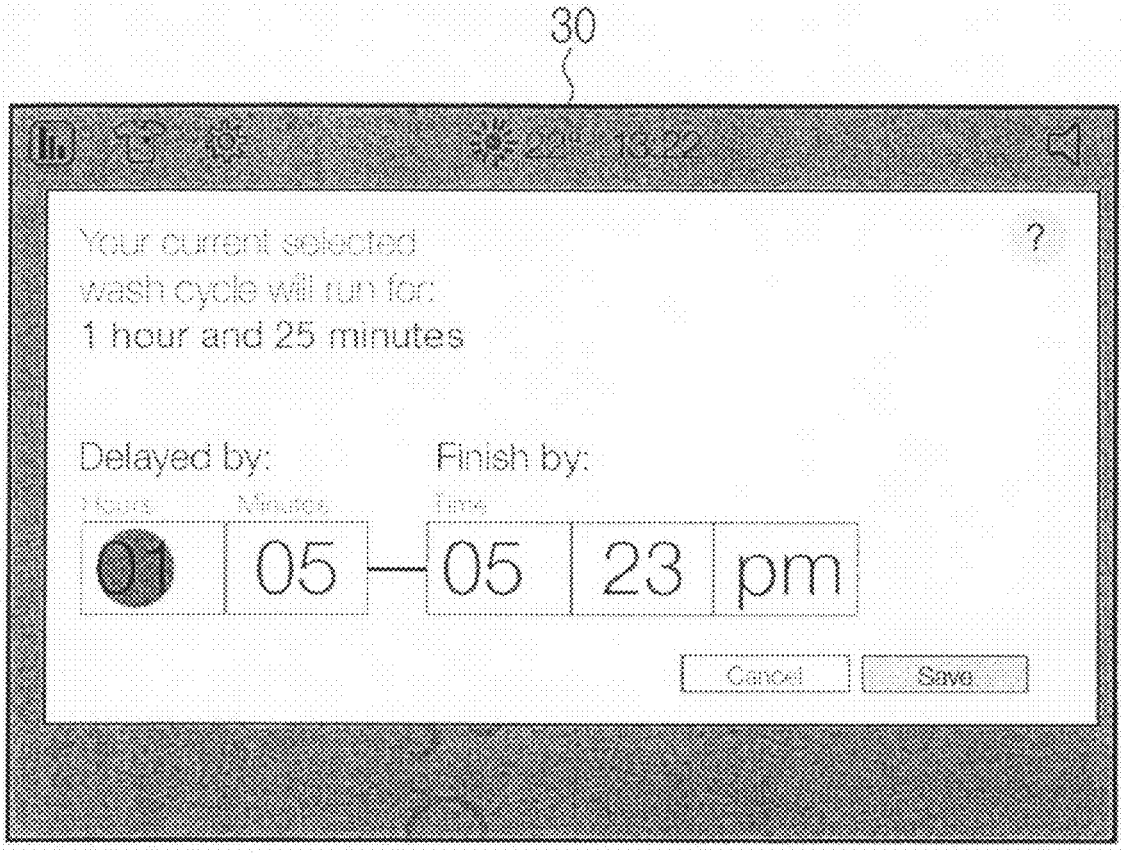
FIG. 10 is a diagram showing a screen to set a delayed wash option in a full-touch LCD according to an embodiment of the present disclosure.

FIG. 10 is a diagram showing a screen to set a delayed wash option in a full-touch LCD according to an embodiment of the present disclosure.

In FIG. 10, if the delayed time is adjusted, a finish time is also changed. For example, the delayed time is adjusted to 01:05, the finish time is changed to 05:23 pm.

Figure 11:
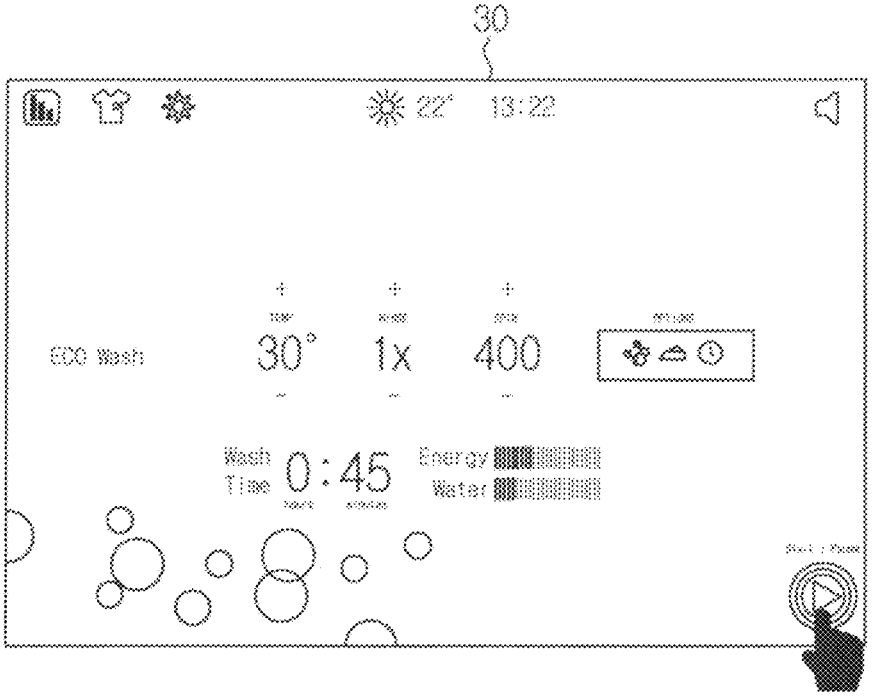
FIG. 11 is a diagram showing a screen to start a wash program in a full-touch LCD according to an embodiment of the present disclosure.

If the wash program and the wash option are selected through the above process, a start screen to perform the selected wash program is displayed as shown in FIG. 11.

FIG. 11 is a diagram showing a screen to start a wash program in a full-touch LCD according to an embodiment of the present disclosure.

Figure 12:
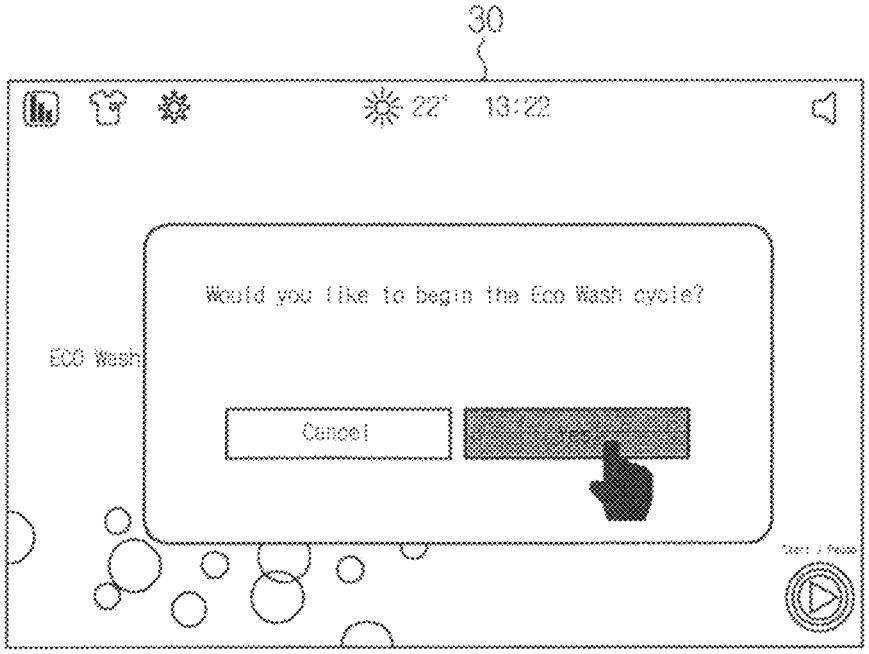
FIG. 12 is a diagram showing a start screen when selecting a wash program in a full-touch LCD according to an embodiment of the present disclosure.

In FIG. 11, when the user touches the start/pause key provided on the lower end of the right side of the full-touch LCD 30 after the basic wash information such as a wash water temperature TEMP (e.g., 30°), a rinse number RINSE (e.g., 1×), a spin RPM SPIN (e.g., 400) is displayed by the selection of the wash program "ECO Wash", the screen of the full-touch LCD 30 is changed to the screen shown in FIG. 12.

FIG. 12 is a diagram showing a start screen when selecting a wash program in a full-touch LCD according to an embodiment of the present disclosure.

In FIG. 12, the full-touch LCD 30 displays a message (Would you like to begin the ECO Wash cycle?) to confirm the start of the wash program (e.g., ECO Wash) selected by the user, in order to enable the user to check whether or not the selected program (e.g., ECO Wash) is executed.

Figure 13:
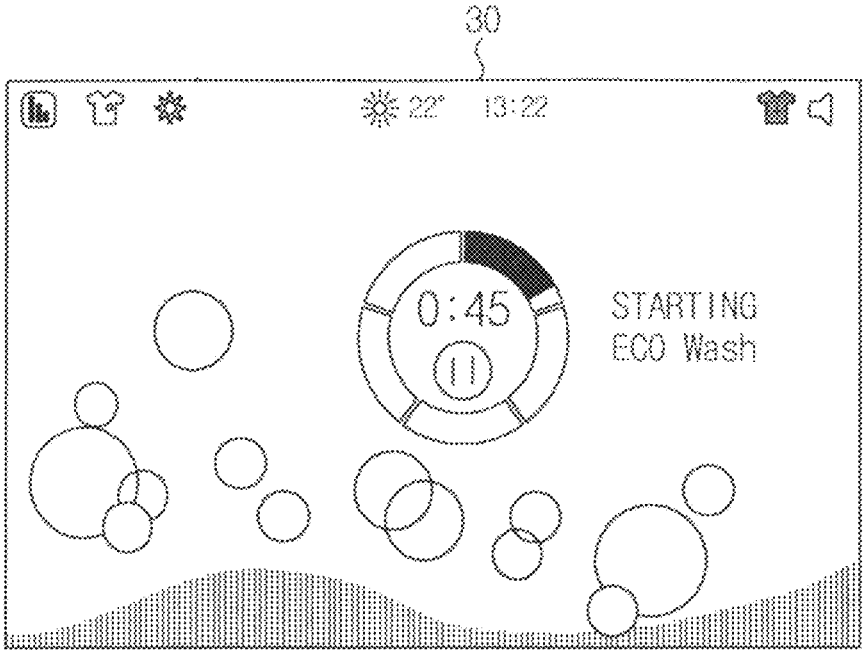
FIG. 13 is a diagram showing the progress state of a wash program in a full-touch LCD according to an embodiment of the present disclosure.

If the user touches a "Yes" field in the displayed message, the screen of the full-touch LCD 30 is switched to the screen shown in FIG. 13 and the cycle of the selected wash program (e.g., "ECO Wash") begins.

FIG. 13 is a diagram showing the progress state of a wash program in a full-touch LCD according to an embodiment of the present disclosure in the case where the selected wash program is "ECO Wash".

In FIG. 13, the start of the wash program "ECO Wash" is displayed and the progress state of the wash program are displayed as shown in FIGS. 14 to 17.

Figure 14:
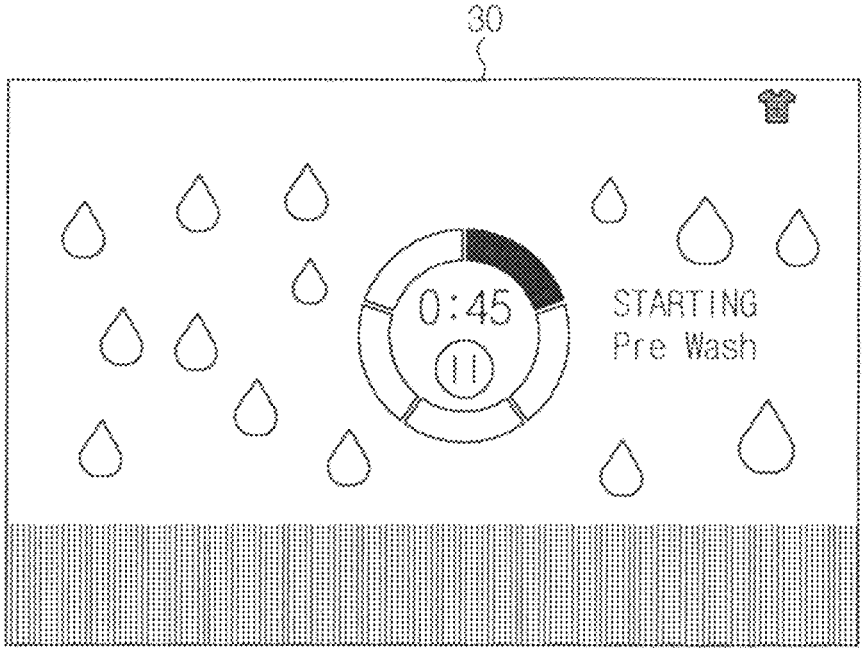
FIG. 14 is a diagram showing a pre-wash progress state of a wash program in a full-touch LCD according to an embodiment of the present disclosure.
Figure 15:
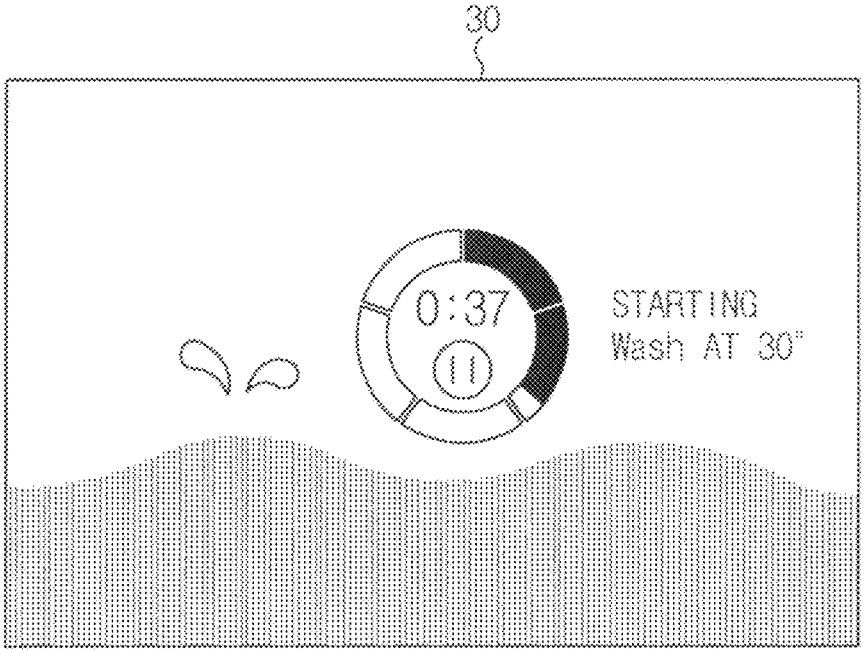
FIG. 15 is a diagram showing a wash progress state of a wash program in a full-touch LCD according to an embodiment of the present disclosure.

FIG. 14 is a diagram showing a pre-wash progress state of a wash program in a full-touch LCD according to an embodiment of the present disclosure, and FIG. 15 is a diagram showing a wash progress state of a wash program in a full-touch LCD according to an embodiment of the present disclosure.

In FIGS. 14 and 15, as the wash program "ECO Wash" progresses, the remaining wash time and the screen suiting the cycle are displayed on the full-touch LCD 30. Then, the user may easily recognize information regarding the operation state (more specifically, pre wash or wash) of the washing machine 1. When the wash cycle is performed, the wash water temperature TEMP (e.g., 30°) corresponding to the wash program "ECO Wash" is displayed. If the user changes the wash water temperature TEMP on the screen of FIG. 6, the changed wash water temperature TEMP is displayed. In this case, the wash time is also changed.

Figure 16:
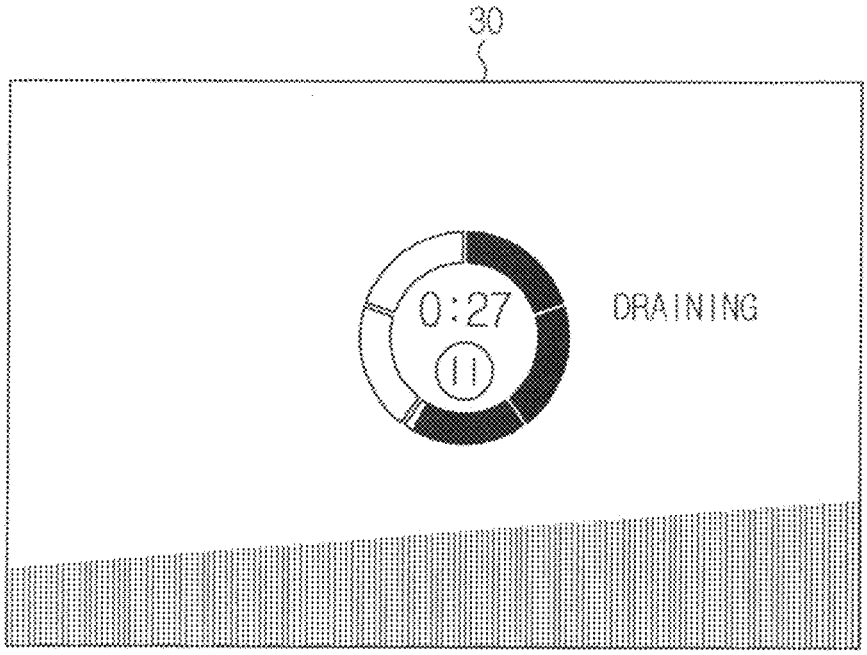
FIG. 16 is a diagram showing a draining progress state of a wash program in a full-touch LCD according to an embodiment of the present disclosure.
Figure 17:
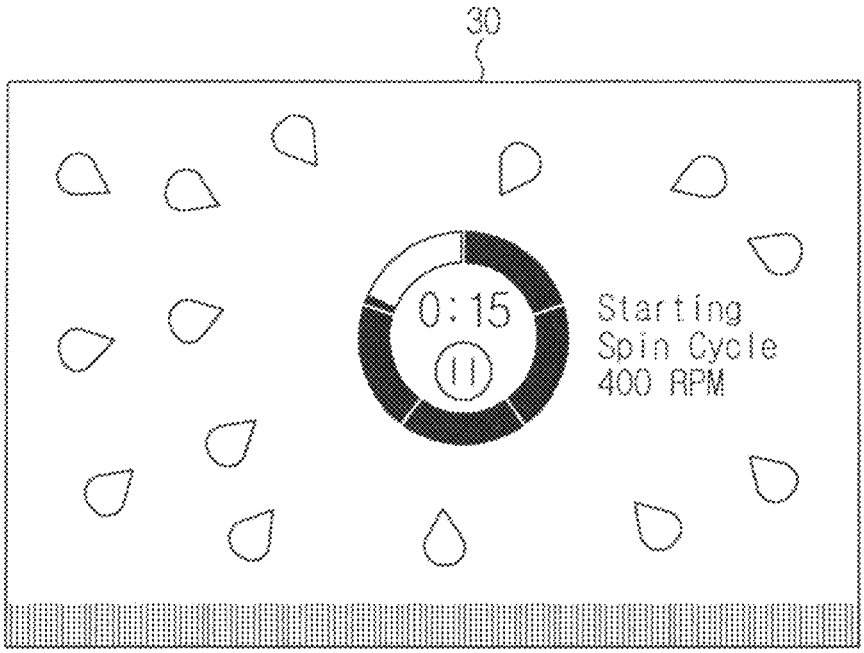
FIG. 17 is a diagram showing a spin cycle progress state of a wash program in a full-touch LCD according to an embodiment of the present disclosure.

FIG. 16 is a diagram showing a draining progress state of a wash program in a full-touch LCD according to an embodiment of the present disclosure, and FIG. 17 is a diagram showing a spin cycle progress state of a wash program in a full-touch LCD according to an embodiment of the present disclosure.

In FIGS. 16 and 17, as the wash program "ECO Wash" progresses, the remaining wash time and the screen suiting the cycle are displayed on the full-touch LCD 30. Then, the user may easily recognize information regarding the operation state (more specifically, draining or spin) of the washing machine 1. When the draining cycle is performed, the spin RPM SPIN (e.g., 400) corresponding to the wash program "ECO Wash" is displayed. If the user changes the spin RPM SPIN on the screen of FIG. 6, the changed spin RPM is displayed.

Figure 18:
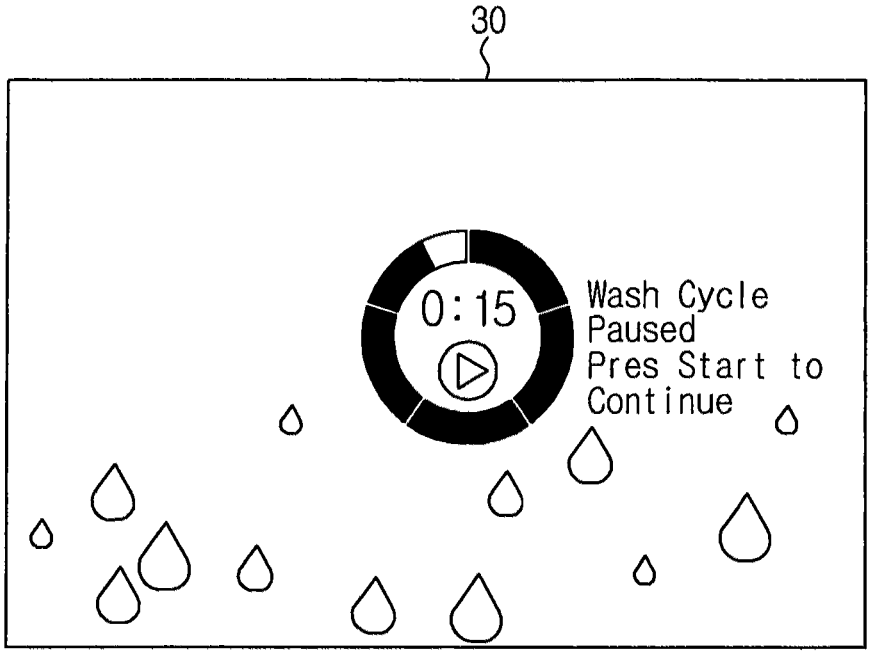
FIG. 18 is a diagram showing a pause state of a wash program in a full-touch LCD according to an embodiment of the present disclosure.

If the user wishes to pause the wash program "ECO Wash", the user touches a pause icon on each of the screens of FIGS. 13 to 17 such that the screen of the full-touch LCD 30 is changed to the screen shown in FIG. 18 while the wash program is paused.

FIG. 18 is a diagram showing a pause state of a wash program in a full-touch LCD according to an embodiment of the present disclosure.

Figure 19:
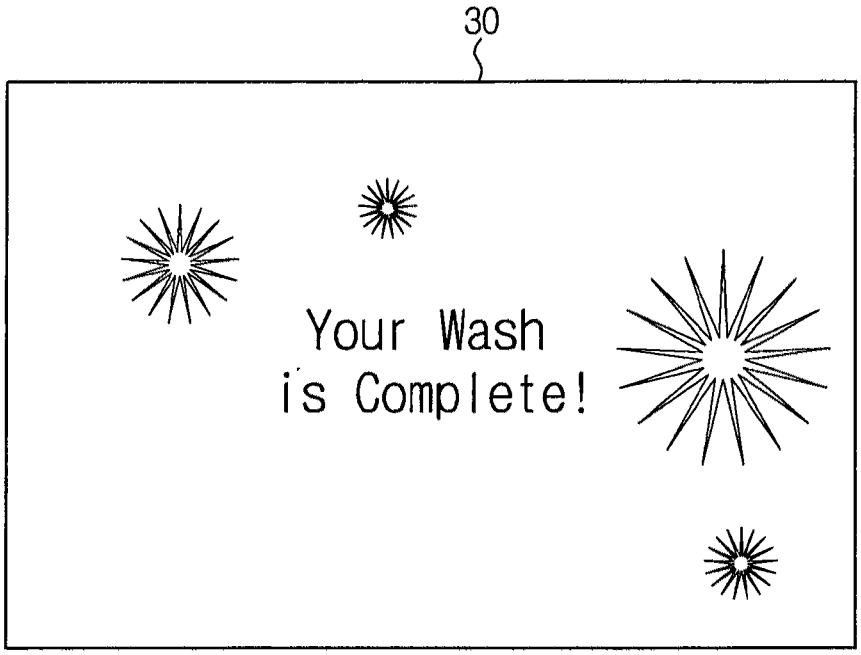
FIG. 19 is a diagram showing a completion state of a wash program in a full-touch LCD according to an embodiment of the present disclosure.

When the wash program "ECO Wash" is complete, a message indicating that washing is complete is displayed on the full-touch LCD 30 as shown in FIG. 19.

FIG. 19 is a diagram showing a completion state of a wash program in a full-touch LCD according to an embodiment of the present disclosure.

Figure 20:
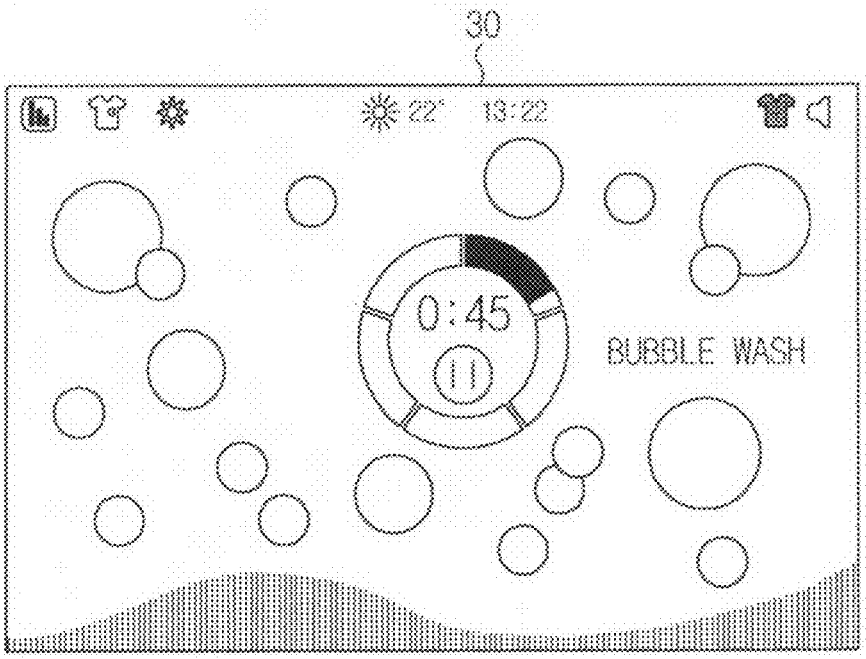
FIG. 20 is a first diagram showing a progress state of a wash program using bubble wash in a full-touch LCD according to an embodiment of the present disclosure.
Figure 21:
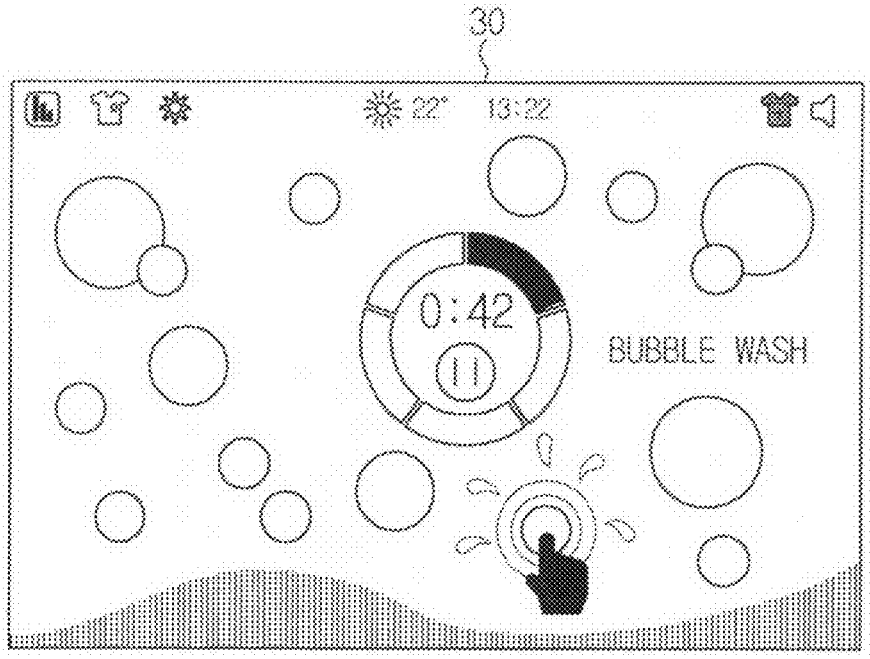
FIG. 21 is a second diagram showing a progress state of a wash program using bubble wash in a full-touch LCD according to an embodiment of the present disclosure.

If bubble wash is selected from among the wash programs, a bubble animation screen is displayed on the full-touch LCD 30 as shown in FIGS. 20 and 21.

The wash programs using bubble wash include ECO Wash, Outdoor Care, Baby Care, Wool and Hand Wash.

FIG. 20 is a first diagram showing a progress state of a wash program using bubble wash in a full-touch LCD according to an embodiment of the present disclosure, and FIG. 21 is a second diagram showing a progress state of a wash program using bubble wash in a full-touch LCD according to an embodiment of the present disclosure.

In FIGS. 20 and 21, when the user touches a bubble image, a screen showing bursting bubbles so as to provide visual/tactile pleasure to the user.

When the user touches a bubble image with a finger and scrolls through bubble images, a screen on which bubbles are burst according to the movement of the finger may be displayed. In addition, sound may be output from the sound output unit 54 according to bubble touch.

The layout of the main screen of the full-touch LCD 30 may be differently set for different countries.

Figure 22:
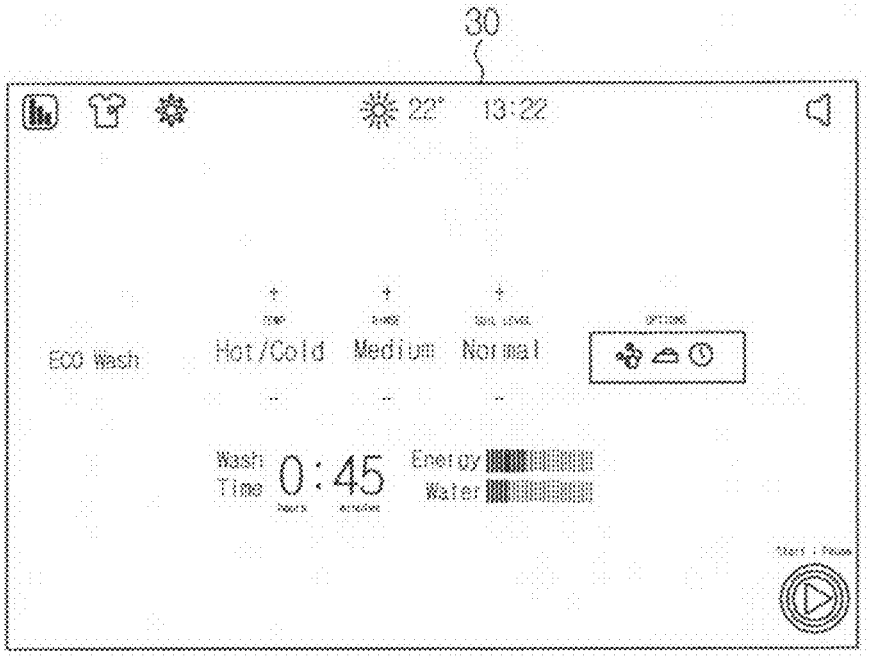
FIG. 22 is a diagram showing another example of a main screen of a full-touch LCD according to an embodiment of the present disclosure.

For example, while the layout of the main screen of the full-touch LCD 30 shown in FIG. 3 may be set in Europe, the layout of the main screen of the full-touch LCD 30 shown in FIG. 22 may be set in the United States of America.

FIG. 22 is a diagram showing another example of a main screen of a full-touch LCD according to an embodiment of the present disclosure, which shows the layout of the screen in the United States of America.

As shown in FIG. 22, the basic wash information displayed on the full-touch LCD 30 is fundamentally similar to that of the European screen layout except that SOIL LEVEL is displayed instead of RINSE.

As can be seen from FIGS. 3 and 22, the layout of the display screen may be differently set according to countries even in the same wash program.

Figure 23:
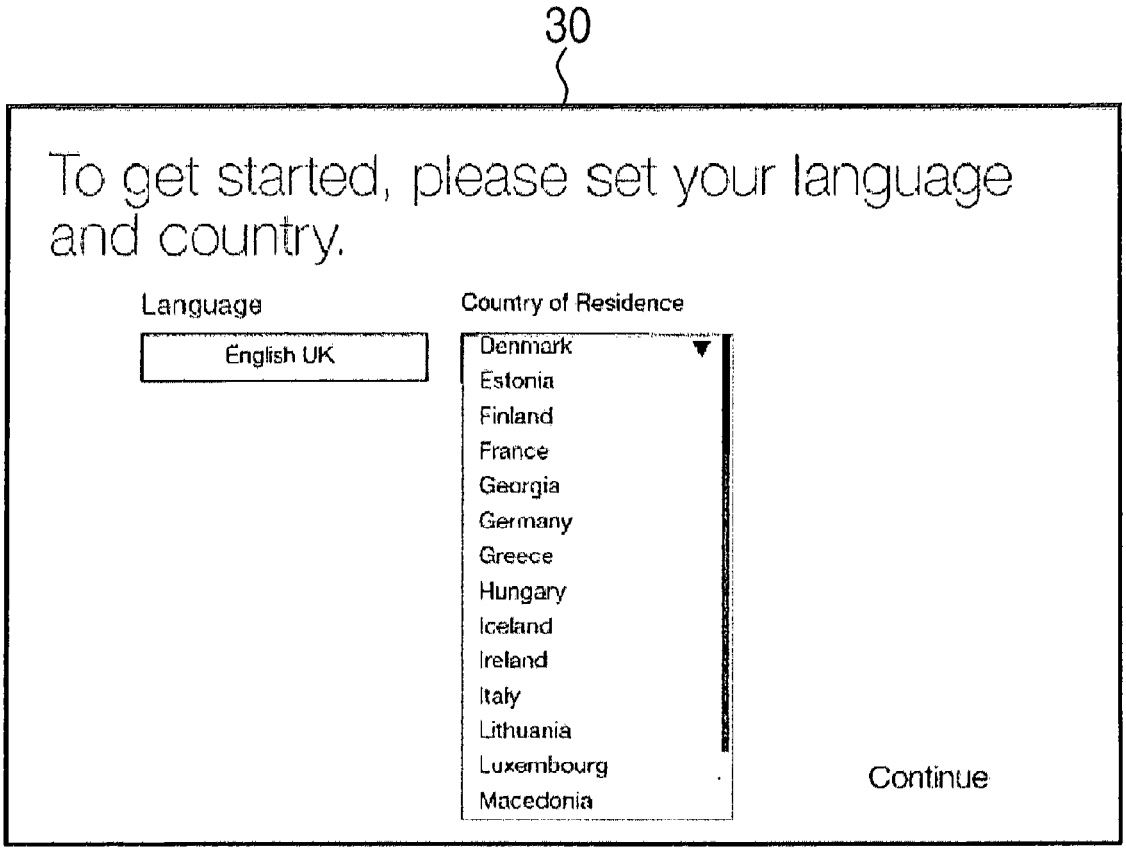
FIG. 23 is a diagram showing a screen to select a language and a country in a full-touch LCD according to an embodiment of the present disclosure.

In order to set the layout of the full-touch LCD 30, the user needs to select a language and a country, as shown in FIG. 23.

FIG. 23 is a diagram showing a screen to select a language and a country in a full-touch LCD according to an embodiment of the present disclosure.

Figure 24:
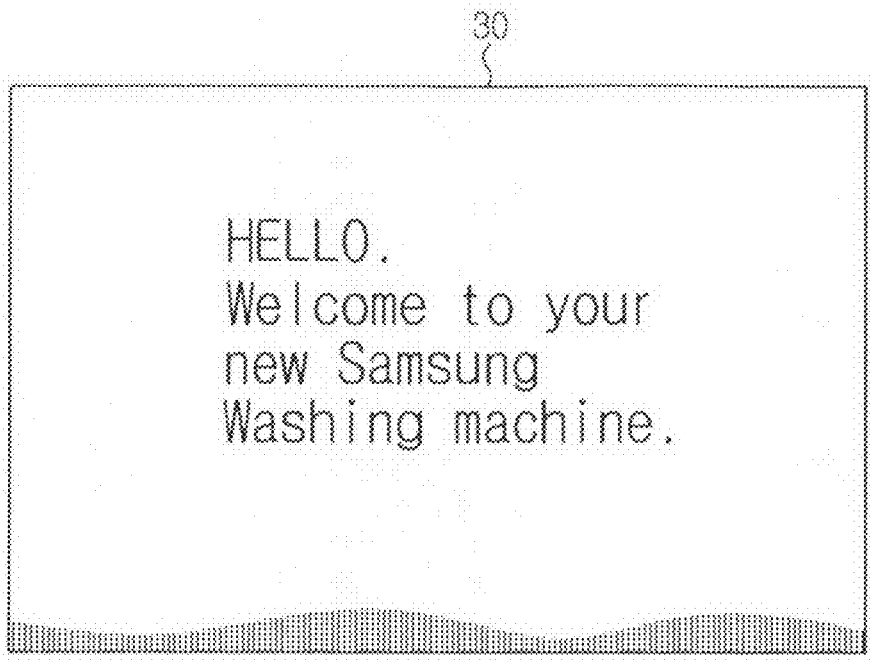
FIG. 24 is a diagram showing a message screen displayed when a language and a country is selected in a full-touch LCD according to an embodiment of the present disclosure.

In FIG. 23, when the user selects a language and a country, the full-touch LCD 30 displays a welcome screen as shown in FIG. 24.

FIG. 24 is a diagram showing a message screen displayed when a language and a country is selected in a full-touch LCD according to an embodiment of the present disclosure.

Figure 25:
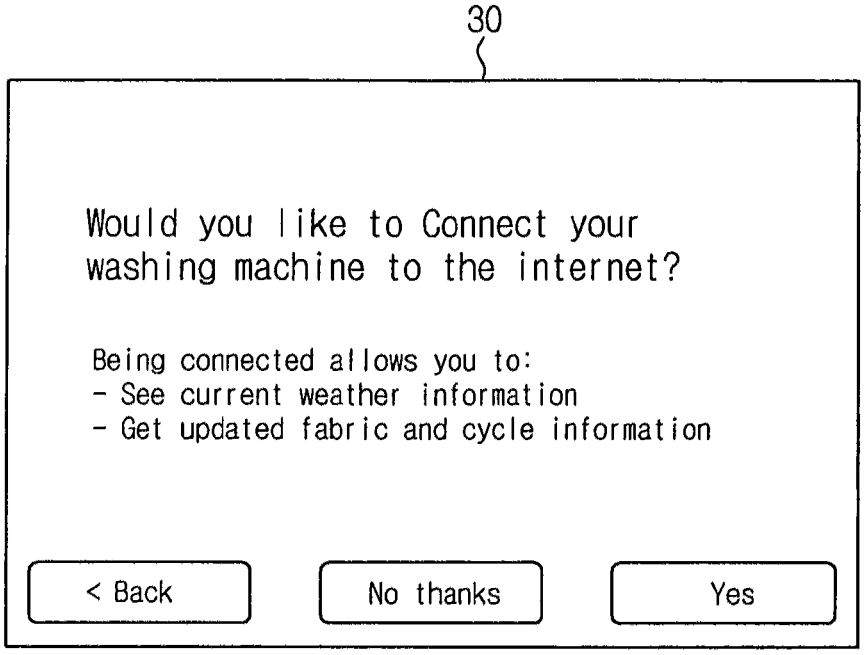
FIG. 25 is a diagram showing a screen to select whether or not a washing machine is connected to a network in a full-touch LCD according to an embodiment of the present disclosure.

When the user selects a language and a country as shown in FIGS. 23 and 24, the full-touch LCD 30 displays a screen to select whether or not the washing machine is connected to a network (Internet) as shown in FIG. 25.

FIG. 25 is a diagram showing a screen to select whether or not the washing machine is connected to a network in a full-touch LCD according to an embodiment of the present disclosure.

Figure 26:
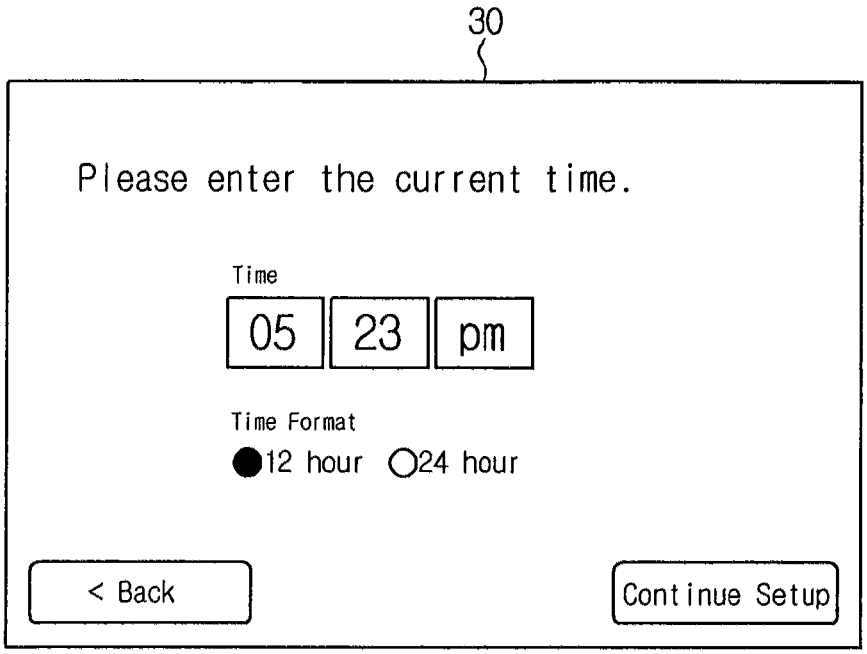
FIG. 26 is a diagram showing a time input screen displayed when network access is not selected in a full-touch LCD according to an embodiment of the present disclosure.

In FIG. 25, when the user does not select network connection (No thanks), the full-touch LCD 30 displays a screen to manually input a current time as shown in FIG. 26.

FIG. 26 is a diagram showing a time input screen displayed when network connection is not selected in a full-touch LCD according to an embodiment of the present disclosure.

Figure 27:
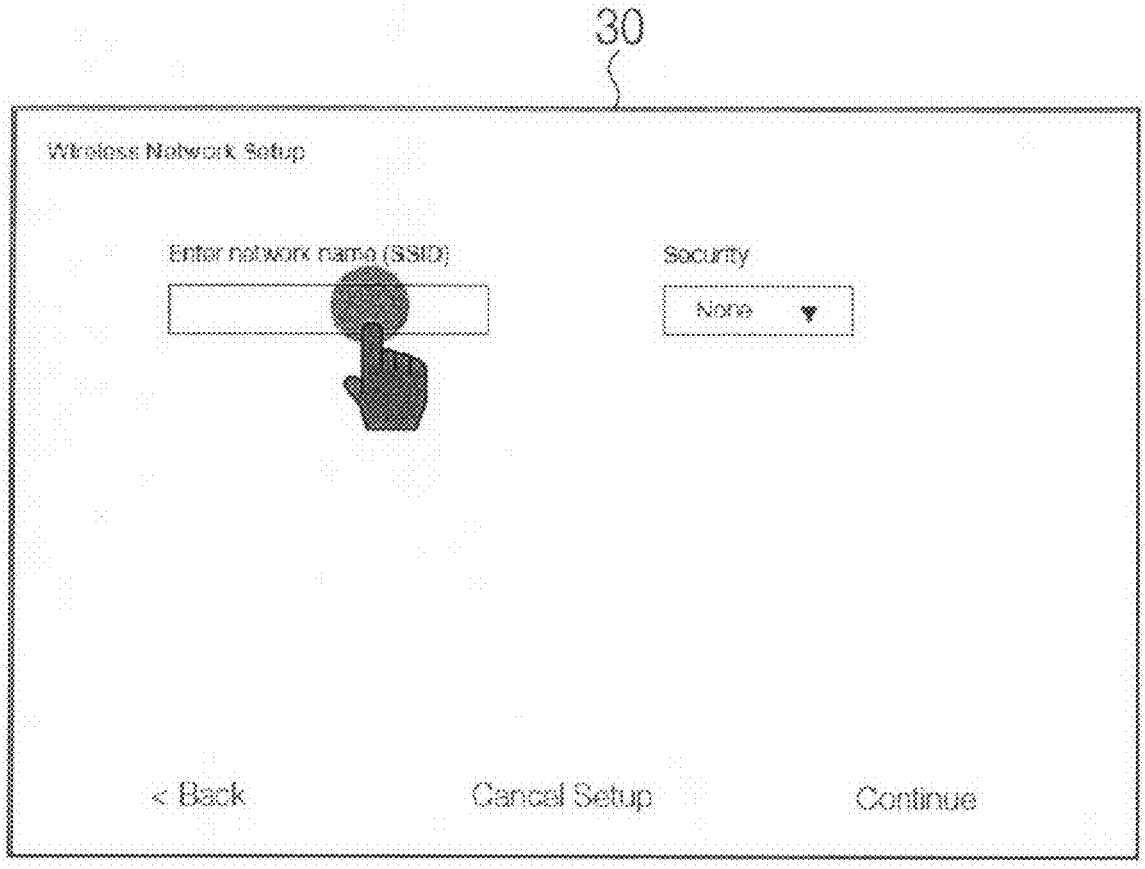
FIG. 27 is a first diagram showing a network setup screen in a full-touch LCD according to an embodiment of the present disclosure.

When the user selects network (Internet) connection (Yes) on the screen shown in FIG. 25, the full-touch LCD 30 displays a wireless network setup screen as shown in FIG. 27.

FIG. 27 is a first diagram showing a network setup screen in a full-touch LCD according to an embodiment of the present disclosure.

Figure 28:
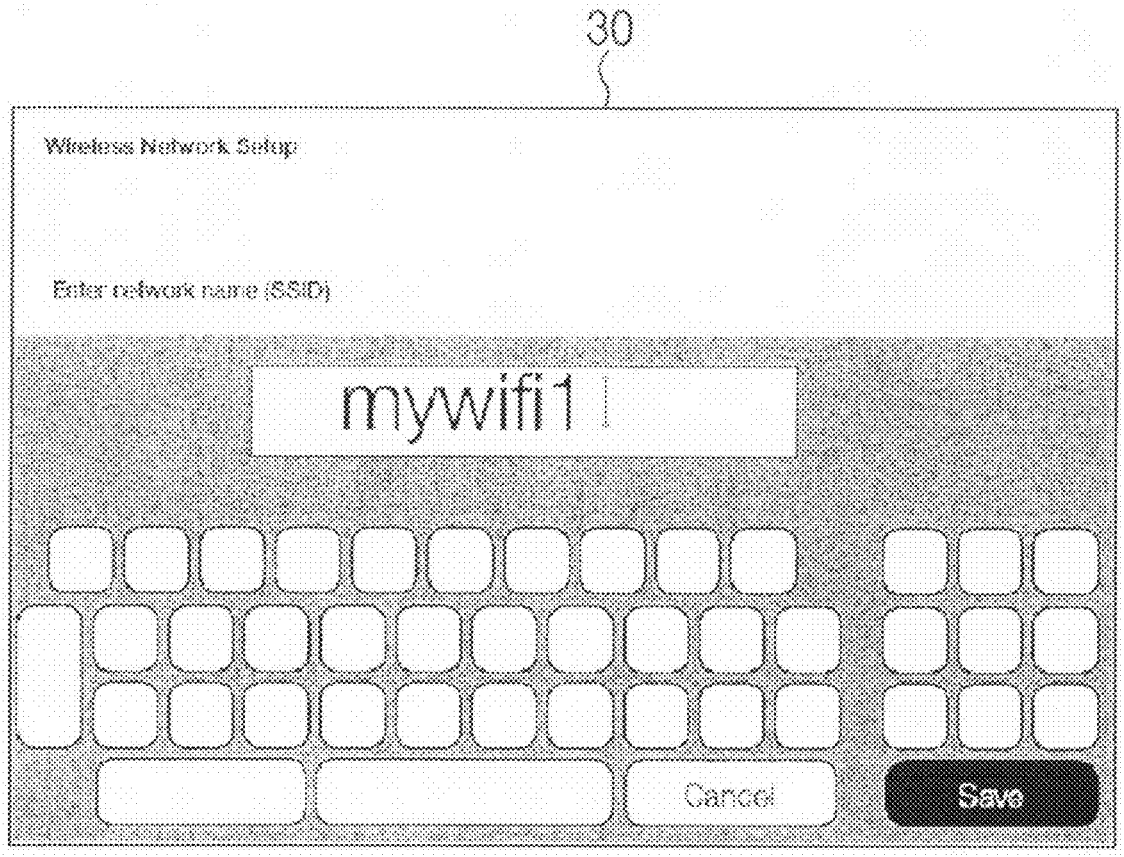
FIG. 28 is a second diagram showing a network setup screen in a full-touch LCD according to an embodiment of the present disclosure.

In FIG. 27, when the user touches a "network name (SSID)" field displayed on the full-touch LCD 30, for network (Internet) setup, the full-touch LCD 30 displays a keyboard as shown in FIG. 28.

FIG. 28 is a second diagram showing a network setup screen in a full-touch LCD according to an embodiment of the present disclosure.

In FIG. 28, the user touches the displayed keyboard and inputs the "network name (SSID)".

Figure 29:
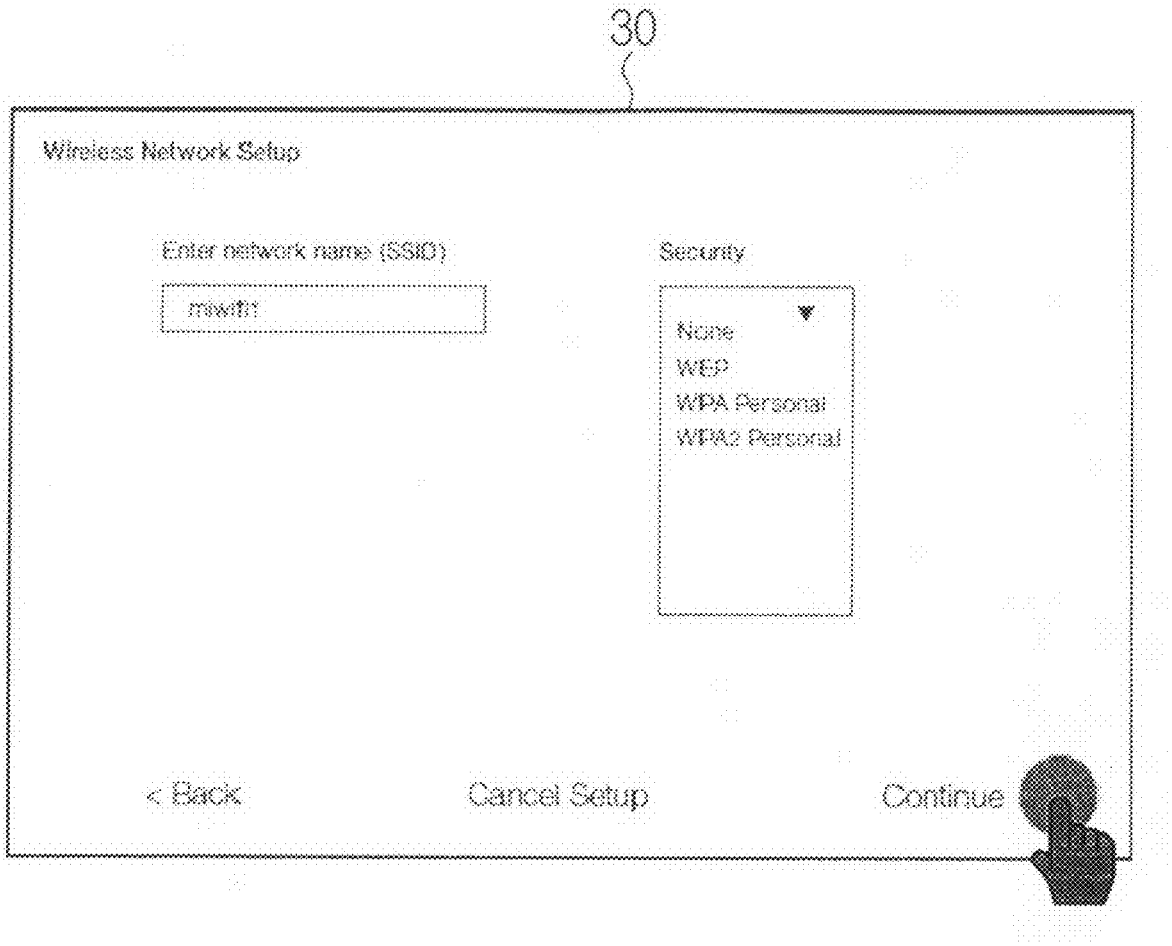
FIG. 29 is a first diagram showing a network setup security screen in a full-touch LCD according to an embodiment of the present disclosure.

When the user inputs the "network name (SSID)" using the keyboard, the full-touch LCD 30 displays a wireless network security screen as shown in FIG. 29.

FIG. 29 is a first diagram showing a network setup security screen in a full-touch LCD according to an embodiment of the present disclosure.

Figure 30:
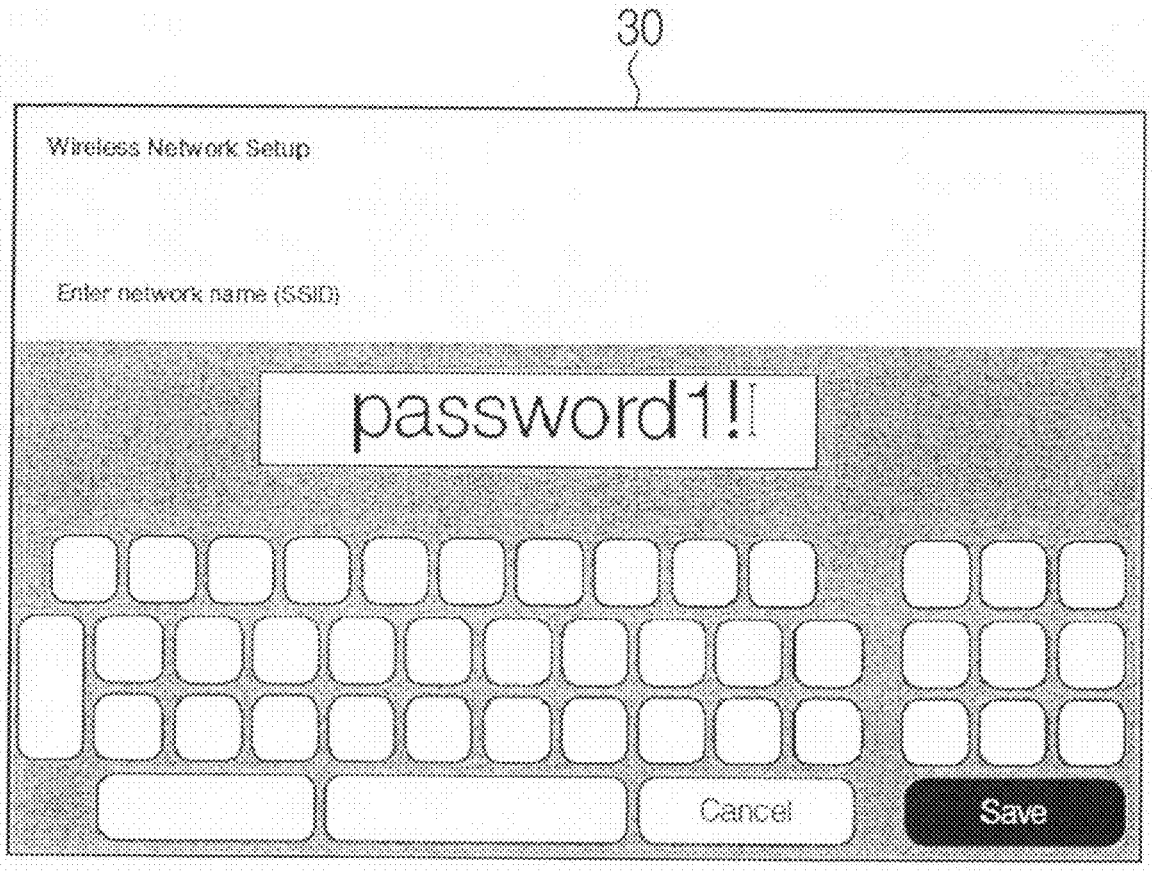
FIG. 30 is a second diagram showing a network setup security screen in a full-touch LCD according to an embodiment of the present disclosure.

In FIG. 29, when the user selects a security type in a right pop-up menu and then touches a button "Continue", the full-touch LCD 30 displays the keyboard as shown in FIG. 30.

FIG. 30 is a second diagram showing a network setup security screen in a full-touch LCD according to an embodiment of the present disclosure.

In FIG. 30, the user touches the displayed keyboard and inputs a "password".

When the user inputs the "password" using the keyboard shown in FIG. 30, a screen indicating that wireless network setup is complete is displayed as shown in FIG. 31.

FIG. 31 is a diagram showing a network setup completion screen in a full-touch LCD according to an embodiment of the present disclosure.

Figure 32:
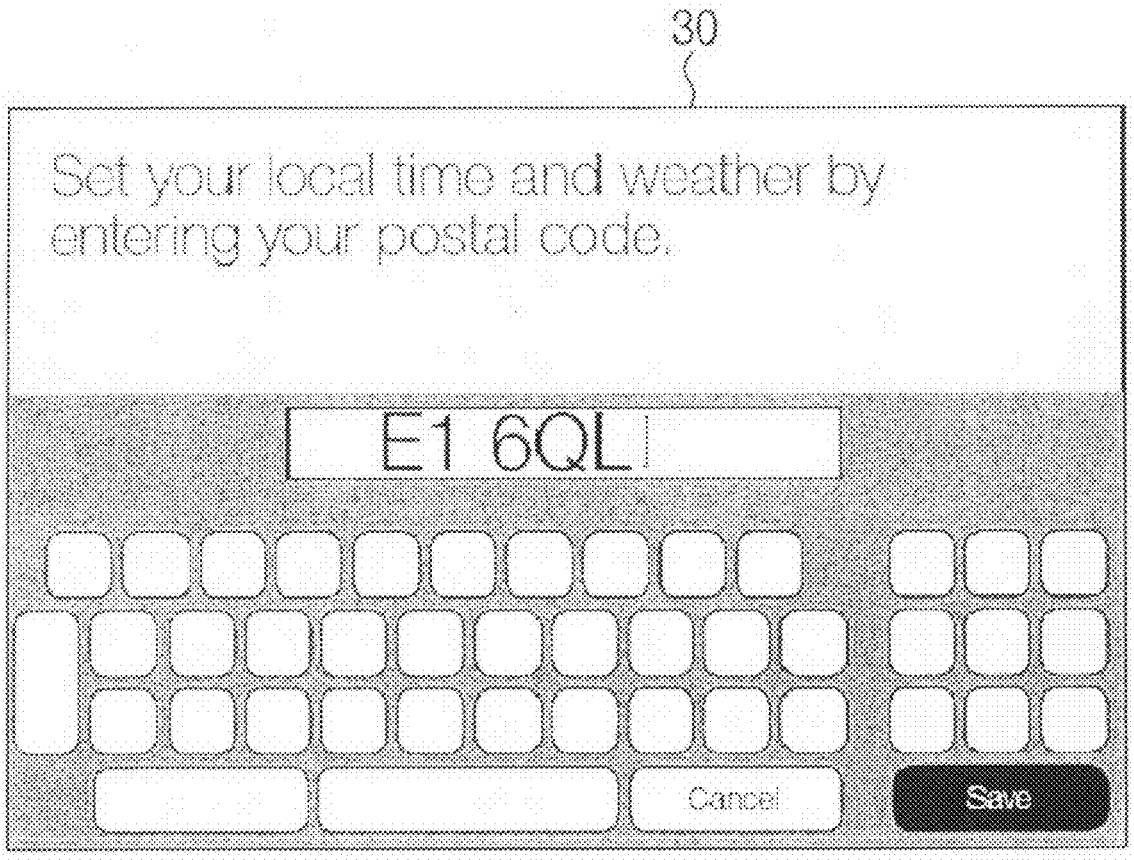
FIG. 32 is a diagram showing a postal code input screen in a full-touch LCD according to an embodiment of the present disclosure.

Next, the full-touch LCD 30 displays a screen to input a postal code as shown in FIG. 32, in order to set local time and weather of a region where the user is located.

FIG. 32 is a diagram showing a postal code input screen in a full-touch LCD according to an embodiment of the present disclosure.

Figure 33:
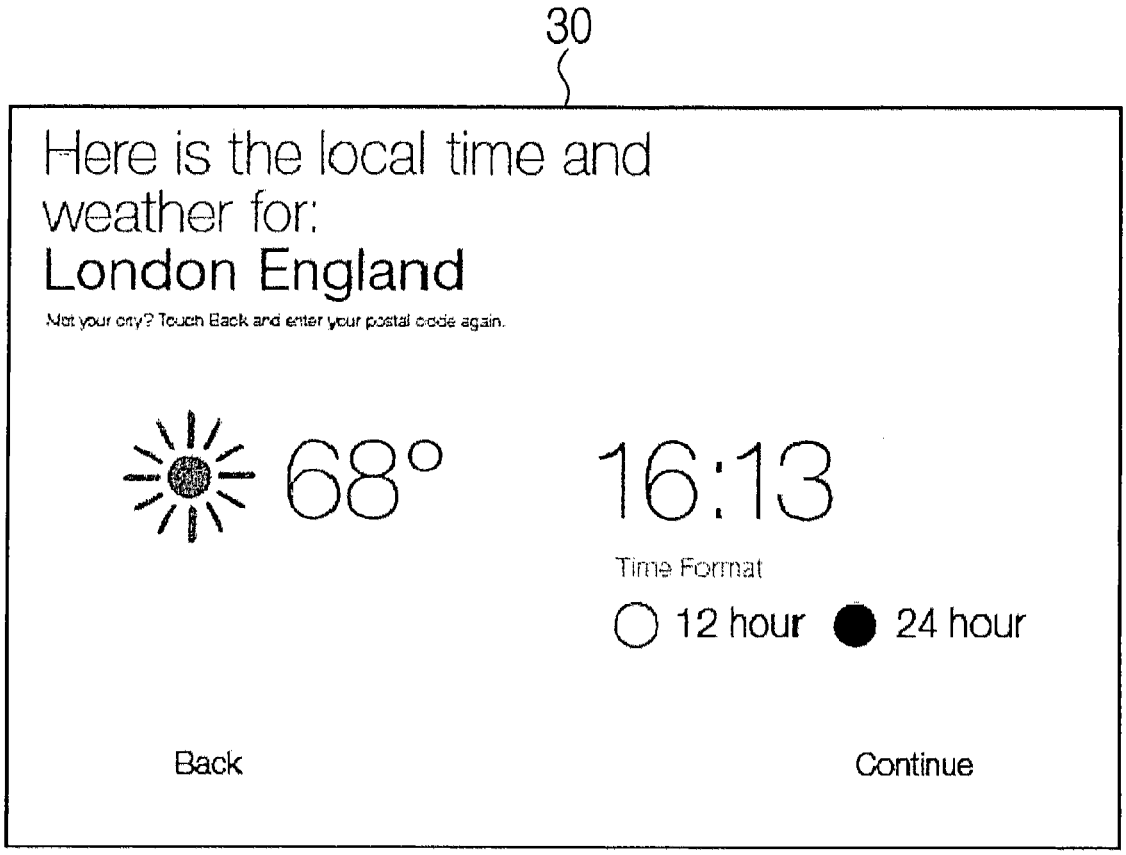
FIG. 33 is a diagram showing local time and weather in a full-touch LCD according to an embodiment of the present disclosure.

In FIG. 32, when the user touches a postal code using the keyboard, the full-touch LCD 30 displays local time and weather as shown in FIG. 33.

FIG. 33 is a diagram showing local time and weather in a full-touch LCD according to an embodiment of the present disclosure.

As shown in FIG. 33, a time (e.g., 16:13) and weather (e.g., 68) of London England are displayed.

Figure 34:
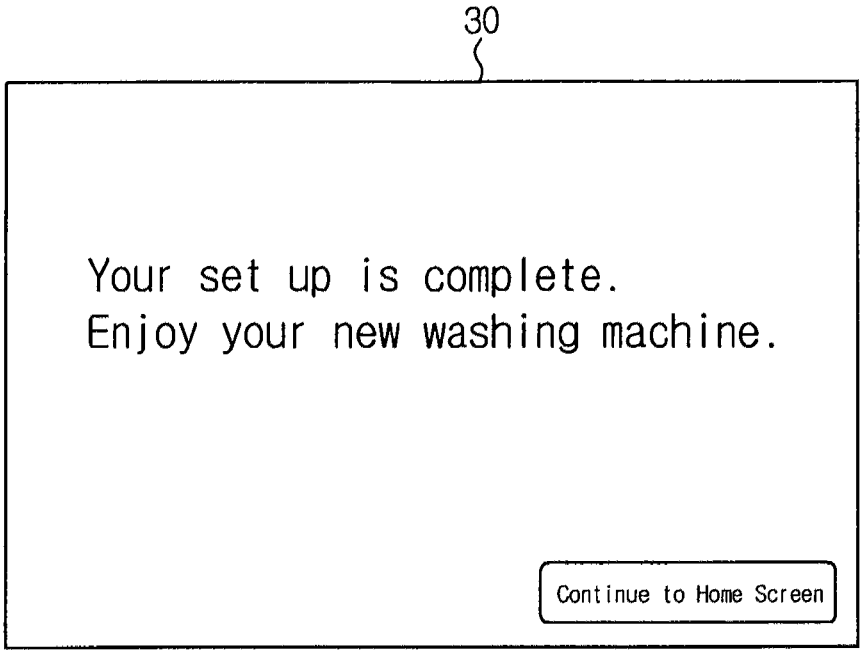
FIG. 34 is a diagram showing a system setup completion screen in a full-touch LCD according to an embodiment of the present disclosure.

If system setup is completed through the above process, the full-touch LCD 30 displays a screen a screen to confirm that system setup is complete as shown in FIG. 34.

FIG. 34 is a diagram showing a system setup completion screen in a full-touch LCD according to an embodiment of the present disclosure.

In FIG. 34, when the user confirms that system setup is complete and touches a button "Continue to Home Screen", the full-touch LCD 30 displays a home screen.

In general, the home screen refers to the main screen shown in FIG. 3 or 22.

Figure 35:
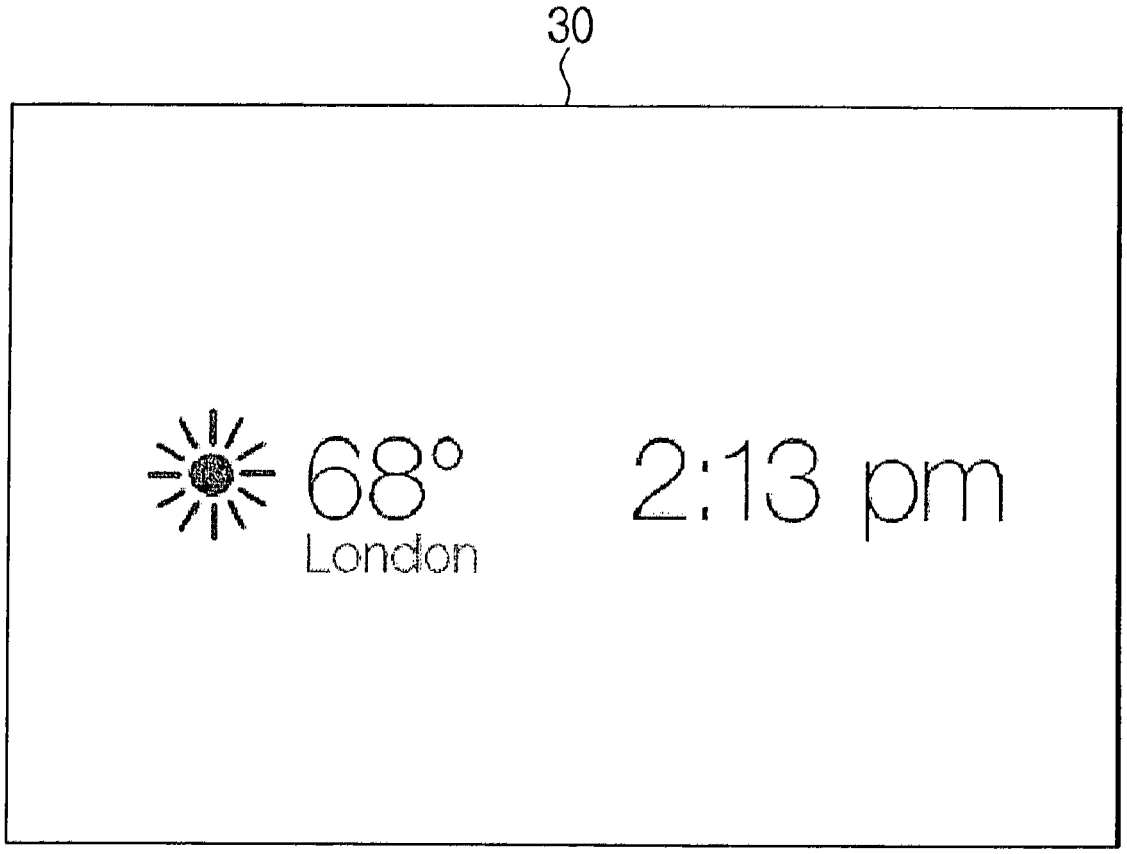
FIG. 35 is a first diagram showing a screen saver state of a full-touch LCD according to an embodiment of the present disclosure.

In addition, the full-touch LCD 30 according to the embodiment of the present disclosure has a screen saver function, as shown in FIG. 35.

FIG. 35 is a first diagram showing a screen saver state of a full-touch LCD according to an embodiment of the present disclosure.

In FIG. 35, when the user touches a key located on the lower end of the right side of the screen, the main screen shown in FIG. 3 or 22 is displayed.

Figure 36:
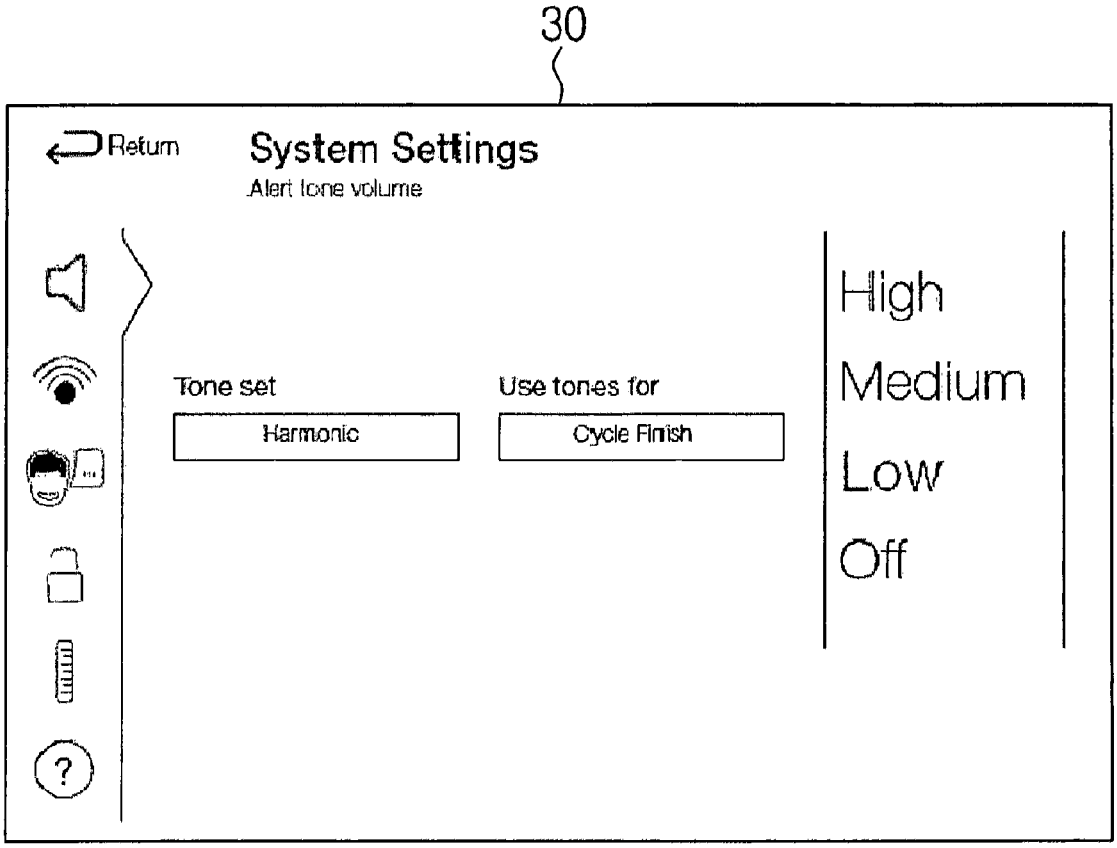
FIG. 36 is a diagram showing a sound setting screen in a full-touch LCD according to an embodiment of the present disclosure.
Figure 37:
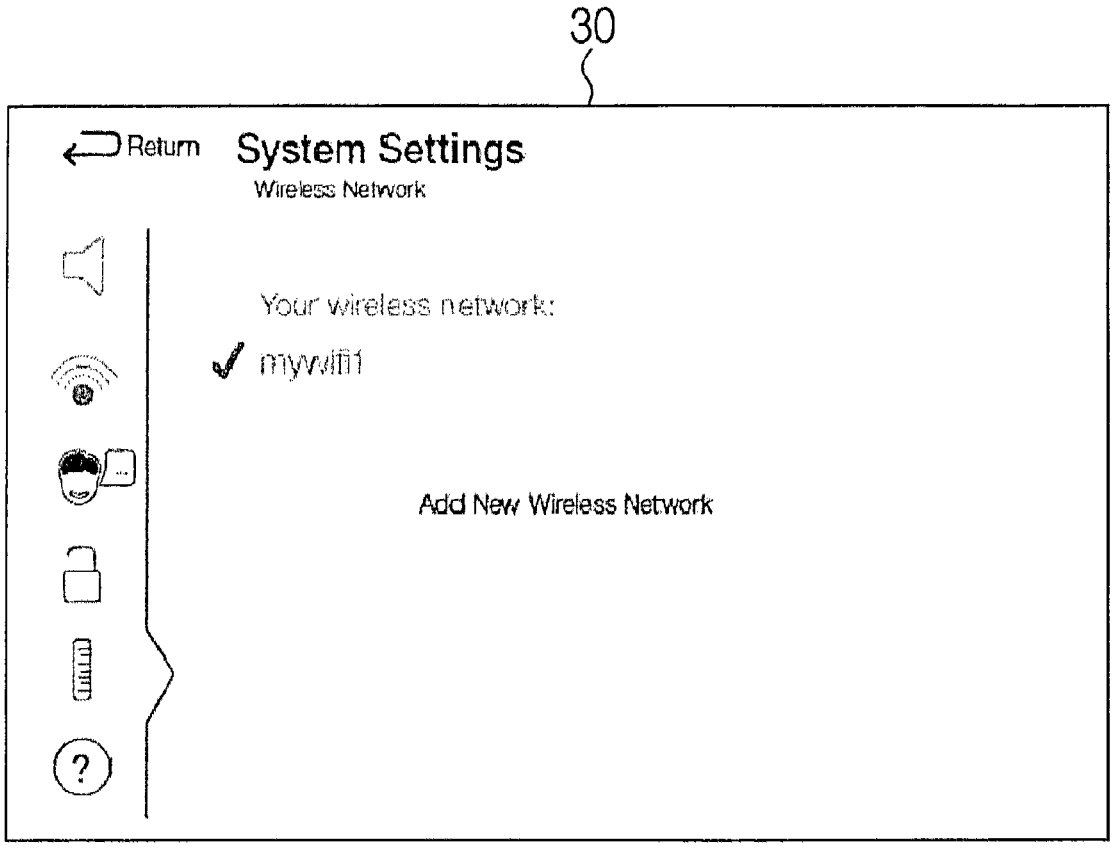
FIG. 37 is a diagram showing a wireless network setting screen in a full-touch LCD according to an embodiment of the present disclosure.

The full-touch LCD 30 according to the embodiment of the present disclosure displays a system setting screen to set sound and a wireless network (WiFi), as shown in FIGS. 36 and 37.

FIG. 36 is a diagram showing a sound setting screen in a full-touch LCD according to an embodiment of the present disclosure, and FIG. 37 is a diagram showing a wireless network setting screen in a full-touch LCD according to an embodiment of the present disclosure.

In FIGS. 36 and 37, if sound is set, a bell may be downloaded over a network.

Figure 38:
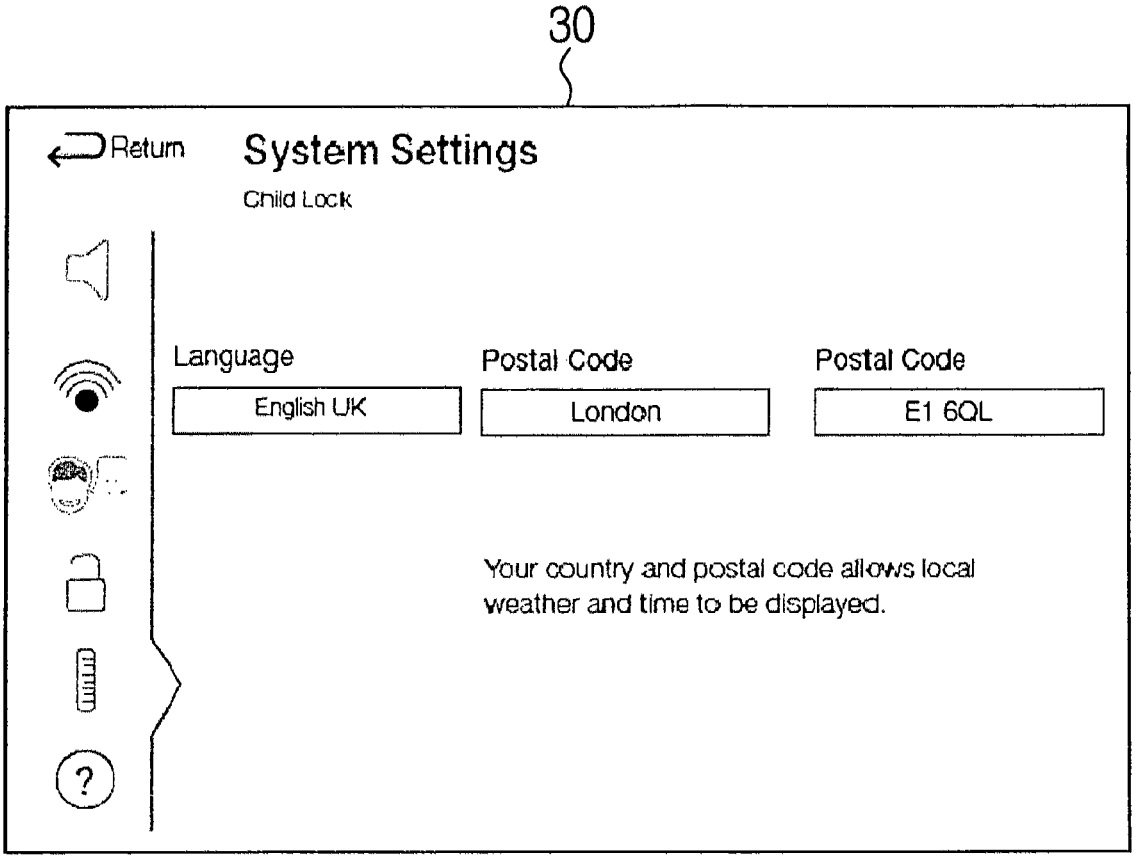
FIG. 38 is a diagram showing a language setting screen in a full-touch LCD according to an embodiment of the present disclosure.
Figure 39:
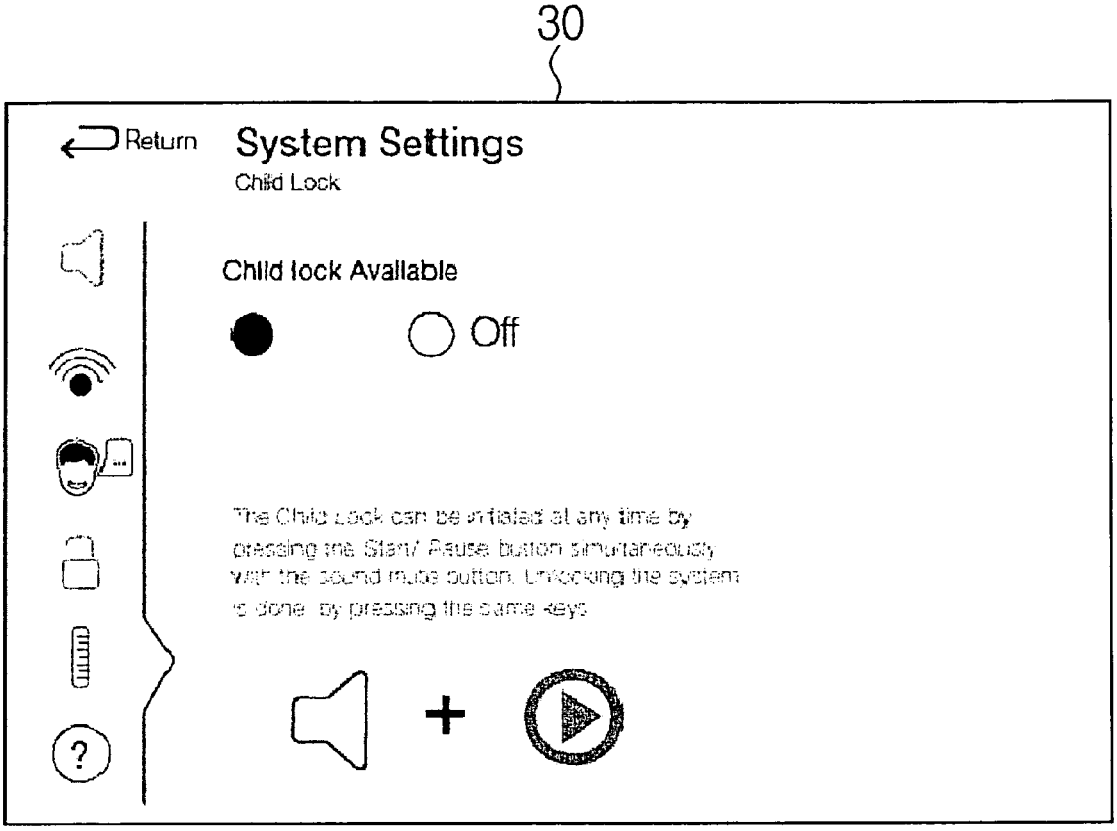
FIG. 39 is a diagram showing a child lock setting screen in a full-touch LCD according to an embodiment of the present disclosure.

The full-touch LCD 30 according to the embodiment of the present disclosure displays a system setting screen to set a language and child lock, which is shown in FIGS. 38 and 39.

Figure 40:
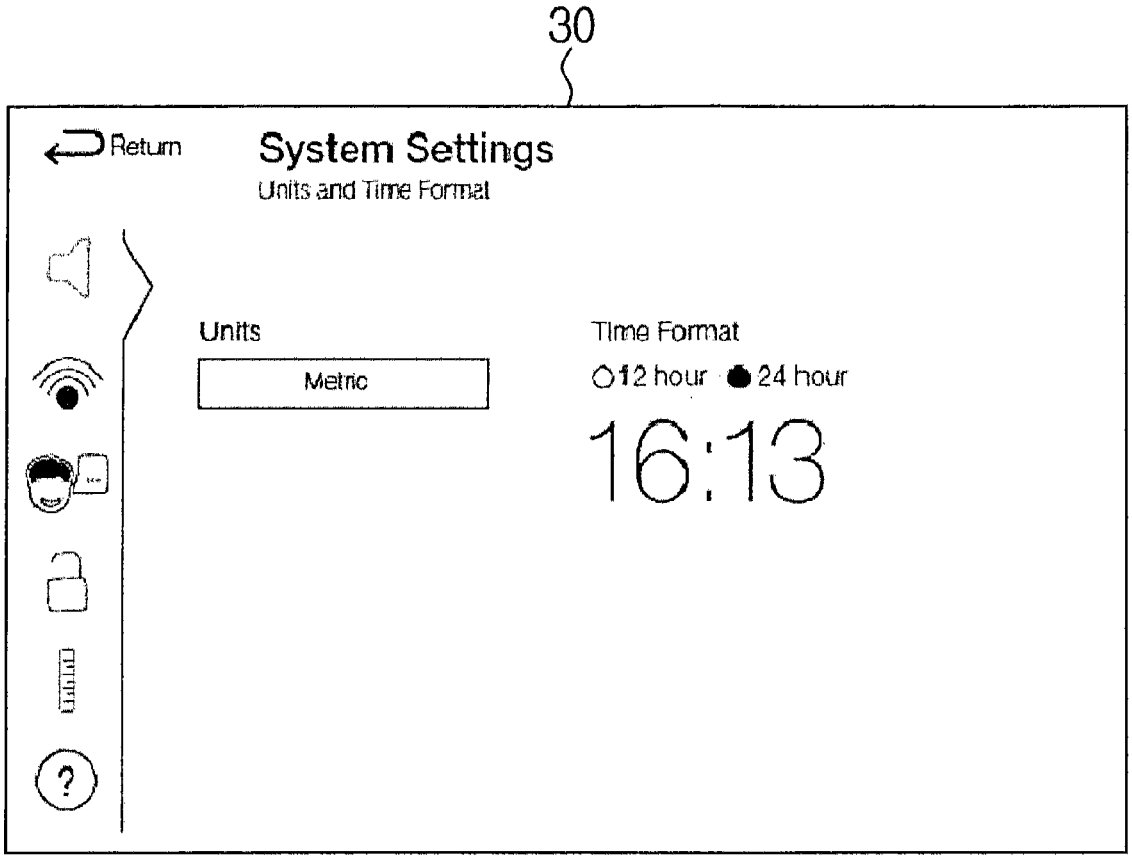
FIG. 40 is a diagram showing a unit setting screen in a full-touch LCD according to an embodiment of the present disclosure.
Figure 41:
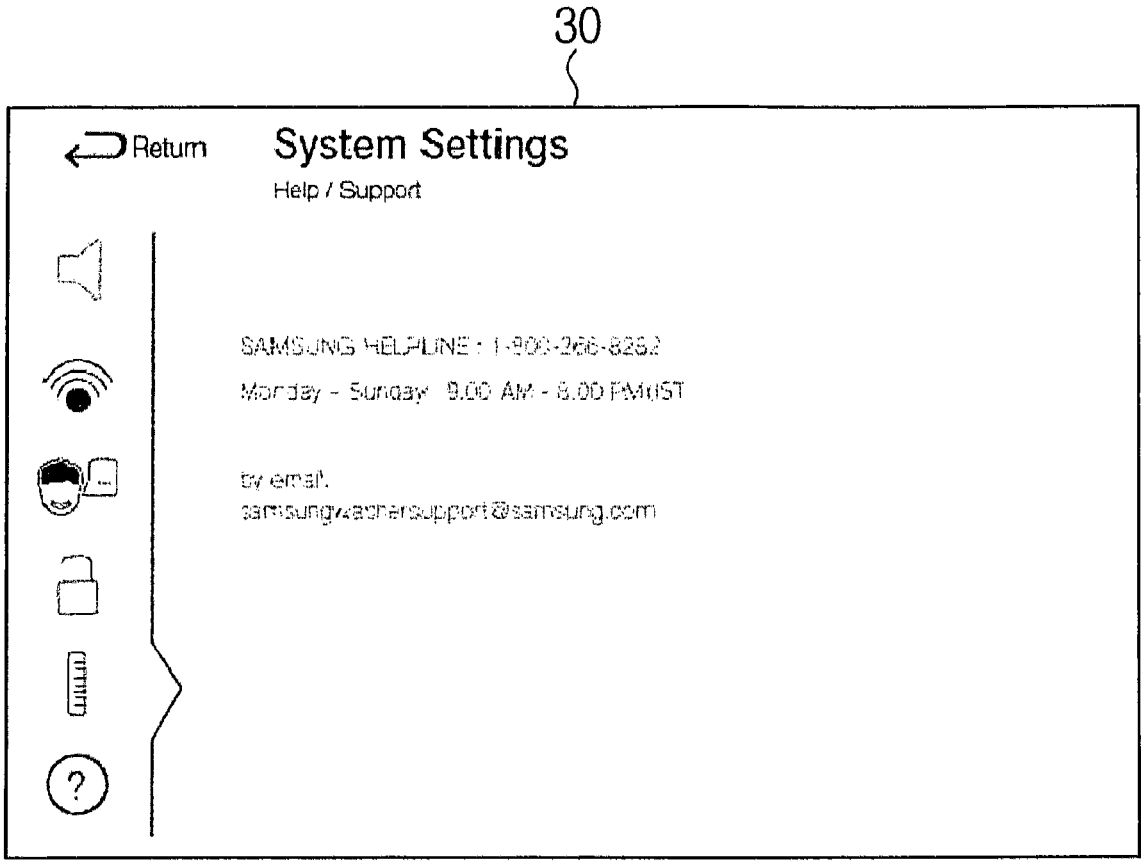
FIG. 41 is a diagram showing a help setting screen in a full-touch LCD according to an embodiment of the present disclosure.

FIG. 38 is a diagram showing a language setting screen in a full-touch LCD according to an embodiment of the present disclosure, and FIG. 39 is a diagram showing a child lock setting screen in a full-touch LCD according to an embodiment of the present disclosure;

The full-touch LCD 30 according to the embodiment of the present disclosure displays a system setting screen to set units and a help screen, which is shown in FIGS. 40 and 41.

FIG. 40 is a diagram showing a unit setting screen in a full-touch LCD according to an embodiment of the present disclosure, and FIG. 41 is a diagram showing a help setting screen in a full-touch LCD according to an embodiment of the present disclosure.

Figure 42:
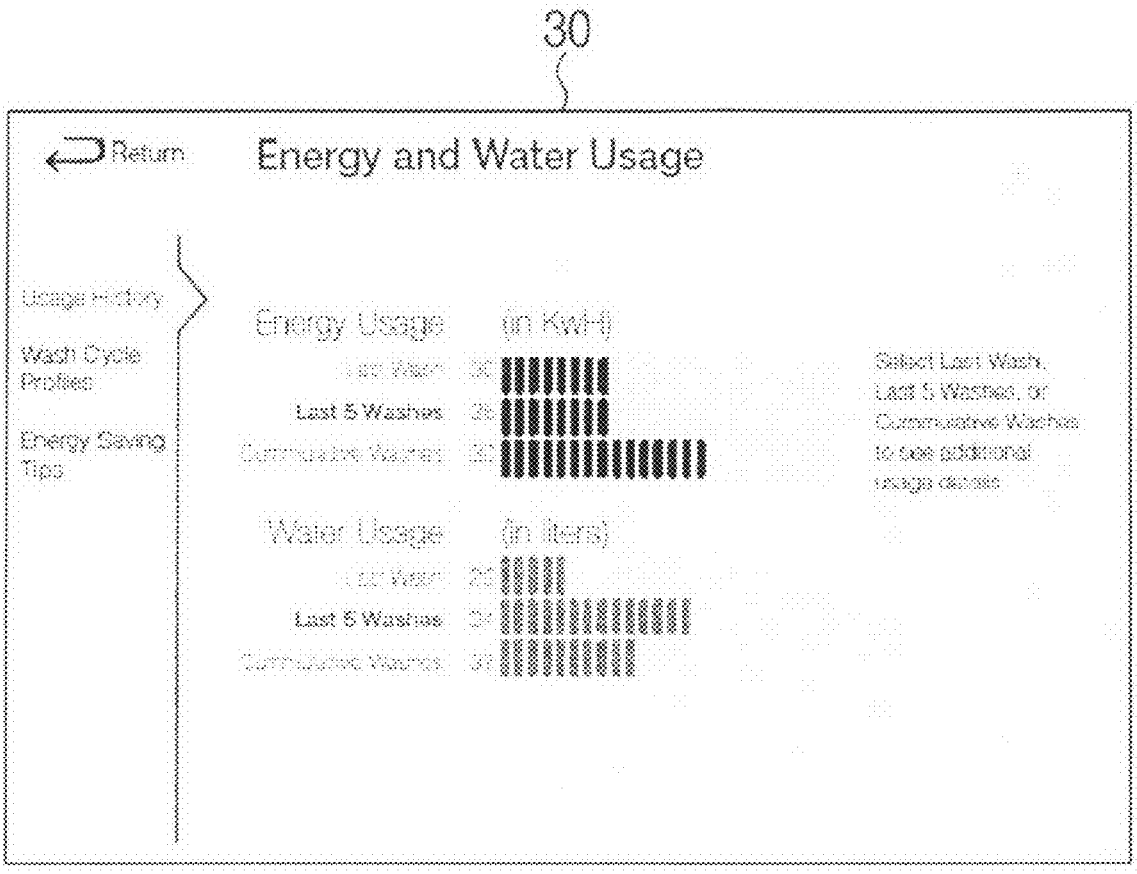
FIG. 42 is a first diagram showing an energy and water usage history screen in a full-touch LCD according to an embodiment of the present disclosure.
Figure 43:
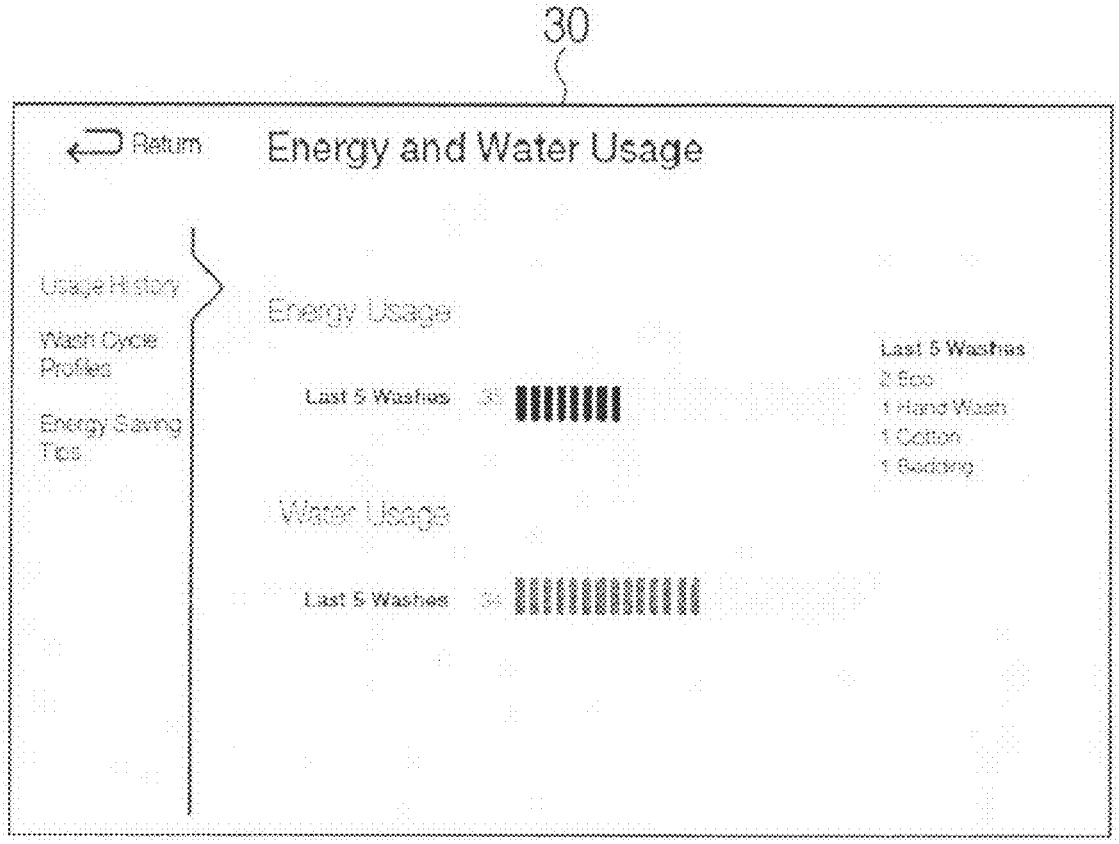
FIG. 43 is a second diagram showing an energy and water usage history screen in a full-touch LCD according to an embodiment of the present disclosure.

The full-touch LCD 30 according to the embodiment of the present disclosure displays an energy and water usage history screen, which is shown in FIGS. 42 and 43.

FIG. 42 is a first diagram showing an energy and water usage history screen in a full-touch LCD according to an embodiment of the present disclosure, and FIG. 43 is a second diagram showing an energy and water usage history screen in a full-touch LCD according to an embodiment of the present disclosure.

The full-touch LCD 30 according to the embodiment of the present disclosure displays a wash program profile of energy and water usage, which will be described with reference to FIGS. 44 and 45.

FIG. 44 is a diagram showing a wash program profile of energy and water usage in a full-touch LCD according to an embodiment of the present disclosure.

Figure 45:
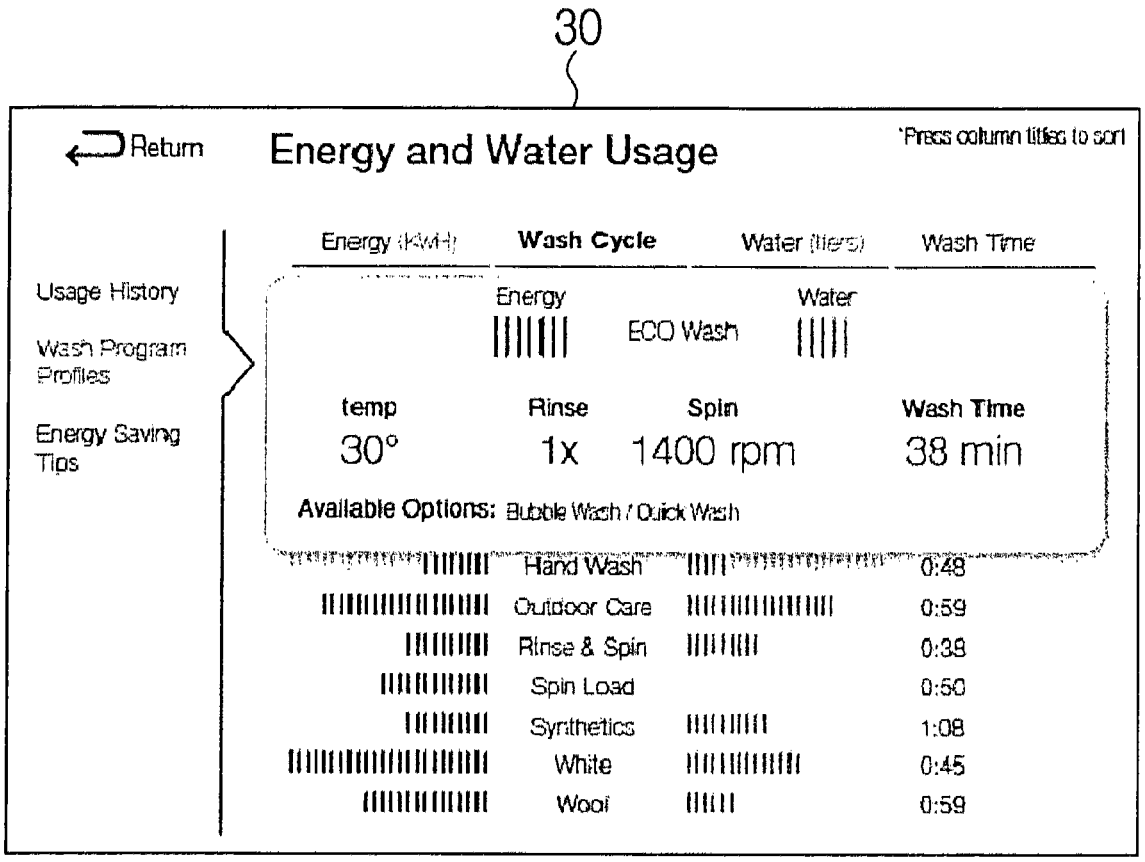
FIG. 45 is a diagram showing an information profile of a wash program in a full-touch LCD according to an embodiment of the present disclosure.

In FIG. 44, when the user touches a desired wash program (e.g., ECO Wash) in order to confirm the detailed information of the wash program, the full-touch LCD 30 displays wash information of the wash program (e.g., ECO Wash) as shown in FIG. 45.

FIG. 45 is a diagram showing an information profile of a wash program in a full-touch LCD according to an embodiment of the present disclosure.

Figure 46:
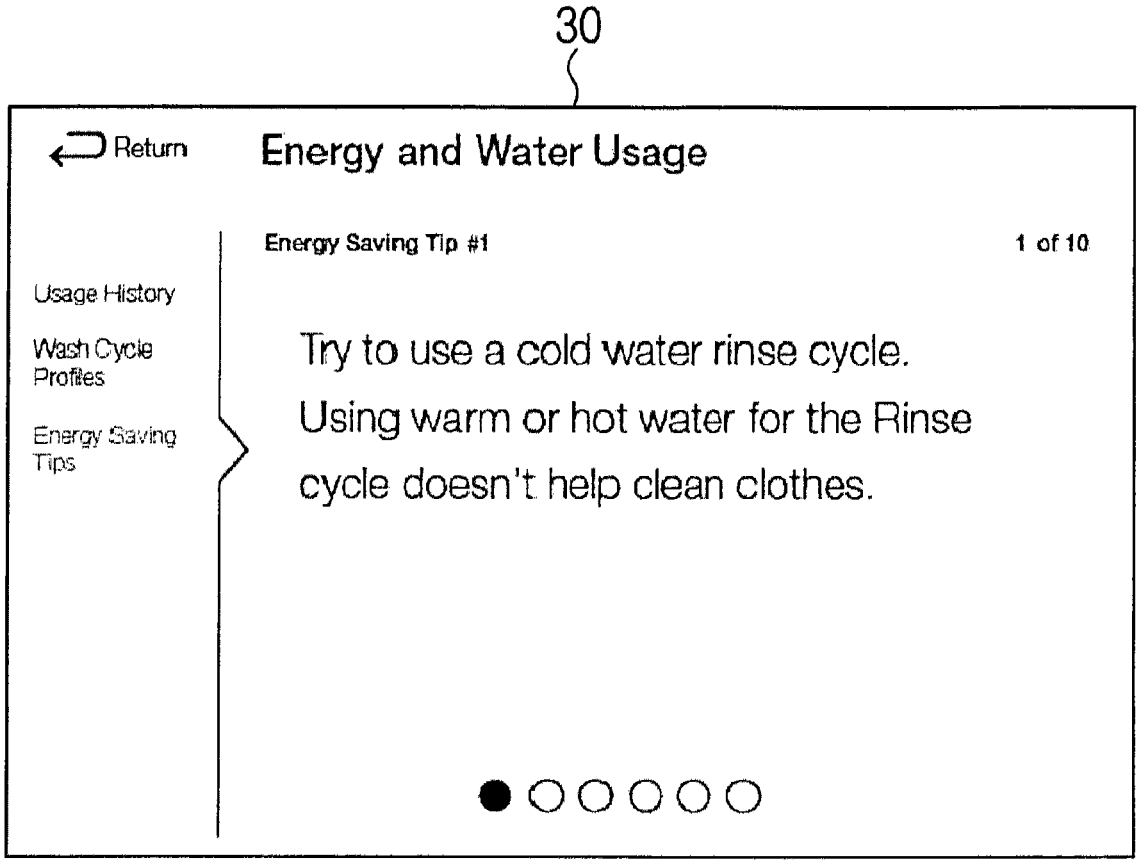
FIG. 46 is a diagram showing energy saving tips of energy and water usage in a full-touch LCD according to an embodiment of the present disclosure.

The full-touch LCD 30 according to the embodiment of the present disclosure displays energy saving tips of energy and water usage, which is shown in FIG. 46.

FIG. 46 is a diagram showing energy saving tips of energy and water usage in a full-touch LCD according to an embodiment of the present disclosure.

Figure 47:
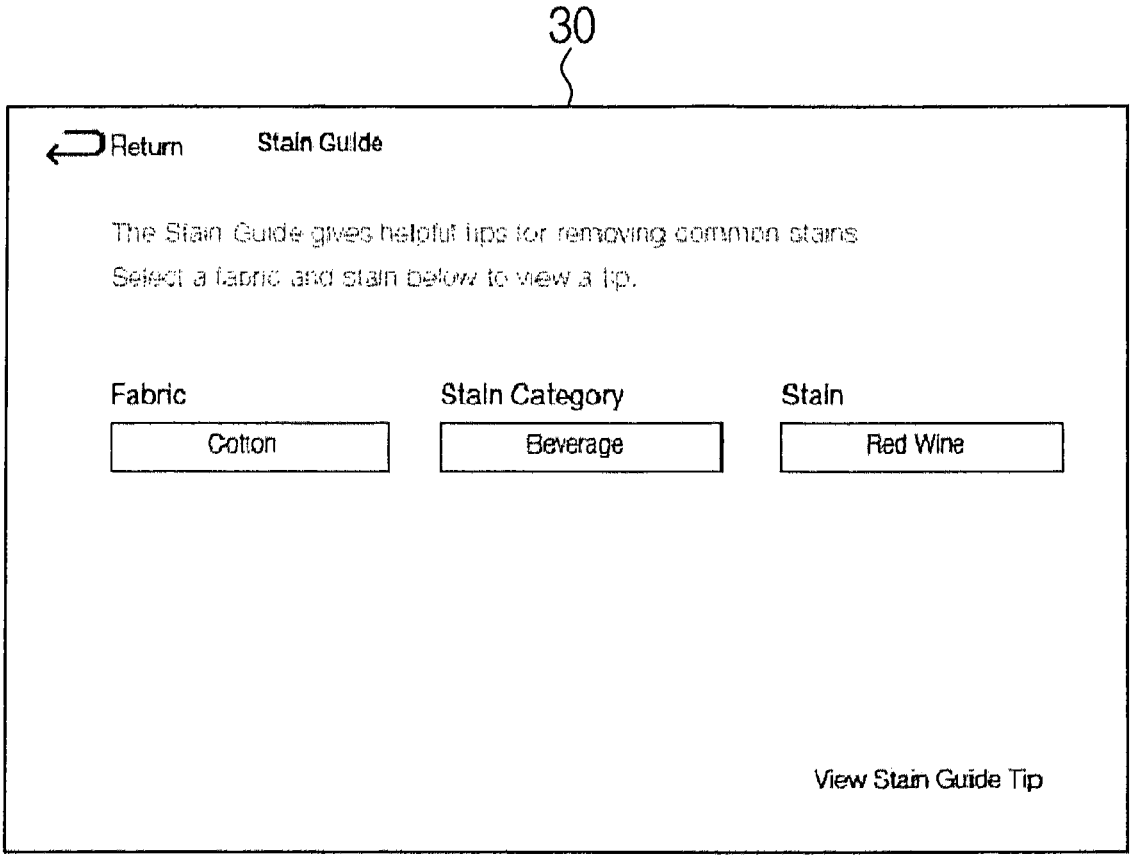
FIG. 47 is a diagram showing a stain guide screen in a full-touch LCD according to an embodiment of the present disclosure.

The full-touch LCD 30 according to the embodiment of the present disclosure displays a screen to remove stains from laundry as shown in FIG. 47.

FIG. 47 is a diagram showing a stain guide screen in a full-touch LCD according to an embodiment of the present disclosure.

In FIG. 47, the full-touch LCD 30 displays a screen including fields "Fabric", "Stain Category" and "Stain" to select a fabric kind and a stain category.

Accordingly, the user touches the field "Fabric" so as to select a fabric kind, touches the fields "Stain Category" and "Stain" so as to select a stain category, and touches a button "View Stain Guide Tip" provided on the lower end of the right side, thereby receiving guide information to remove stains from laundry. This will now be described in greater detail.

Figure 48:
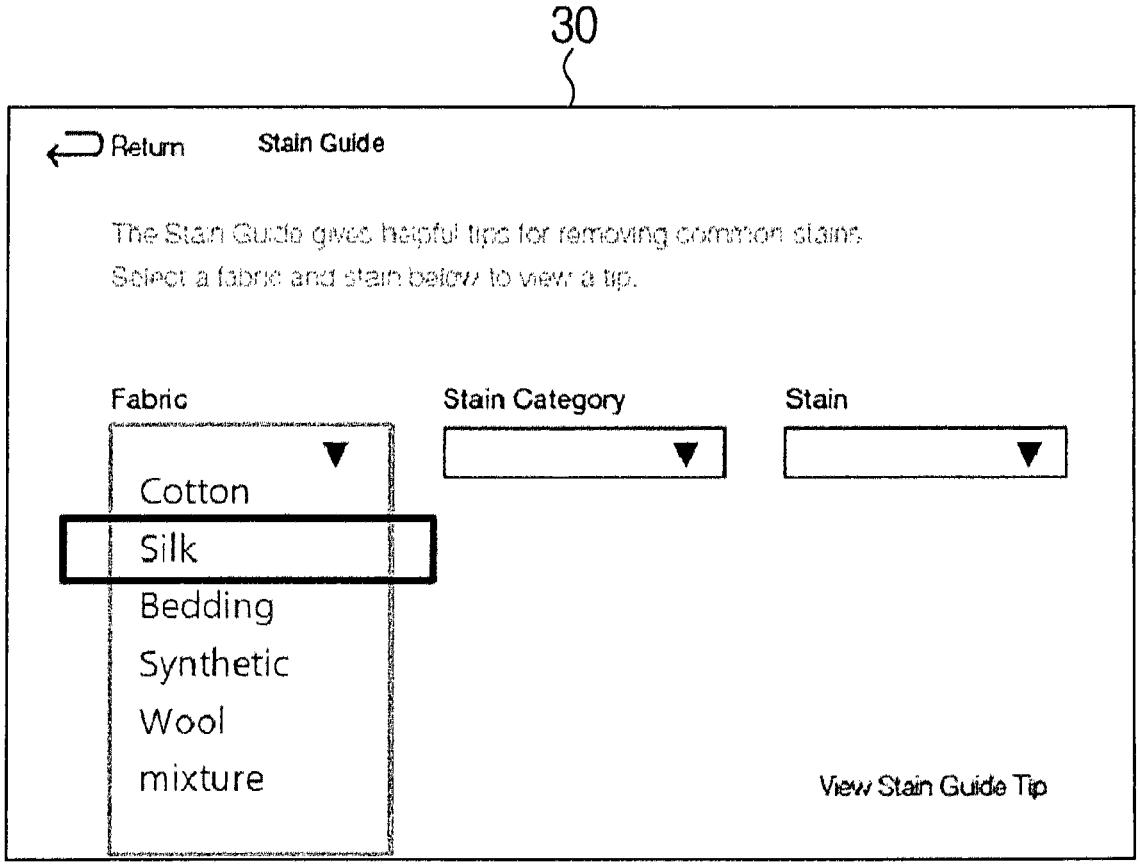
FIG. 48 is a diagram showing a screen to select a fabric kind in a full-touch LCD according to an embodiment of the present disclosure.

In FIG. 47, when the user touches the field "Fabric" provided on the left side of the screen in order to select the fabric kind, a pop-up menu is activated and displayed as shown in FIG. 48.

FIG. 48 is a diagram showing a screen to select a fabric kind in a full-touch LCD according to an embodiment of the present disclosure.

In FIG. 48, the full-touch LCD 30 displays a pop-up menu including Cotton, Silk, Bedding, Synthetic, Wool and mixture in the field "fabric".

Therefore, the user touches the activated pop-up menu and selects a fabric kind (e.g., Silk).

Figure 49:
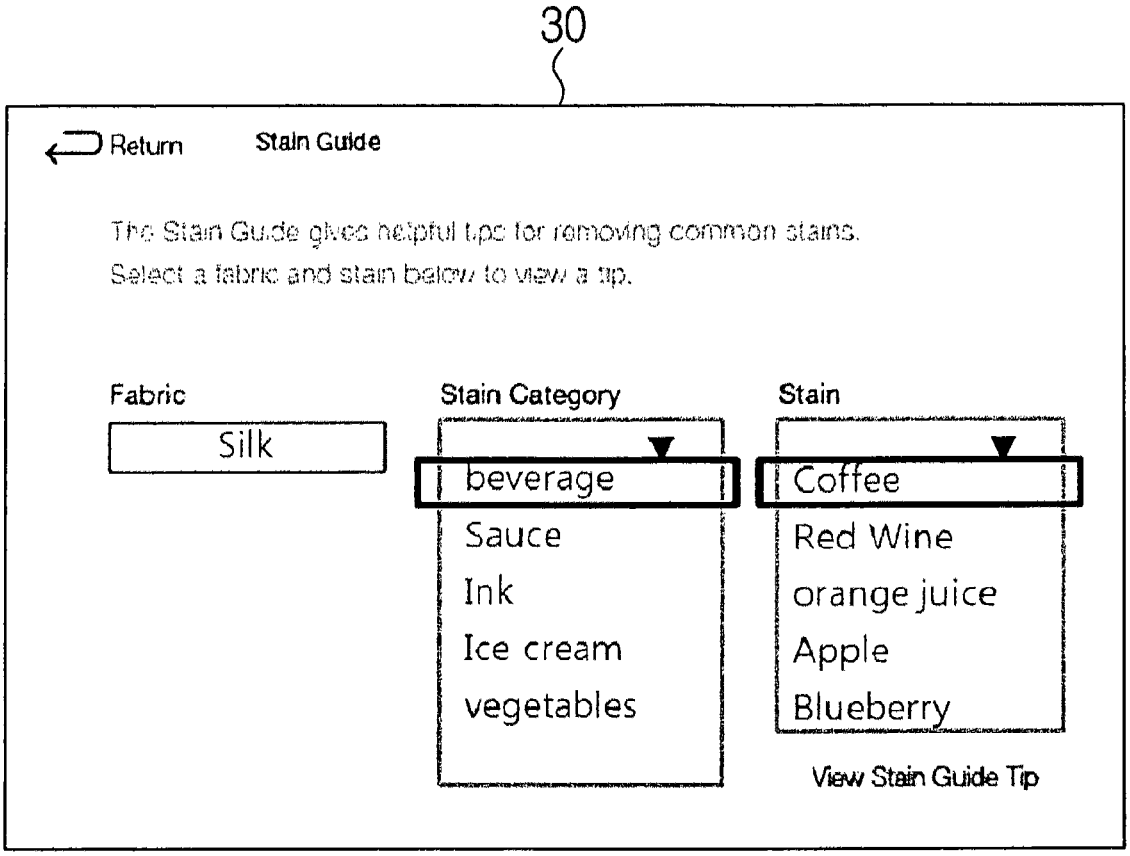
FIG. 49 is a diagram showing a screen to select a stain category in a full-touch LCD according to an embodiment of the present disclosure.

When the user selects the fabric kind and then touches the field "Stain Category" and the field "Stain" provided on the central portion of the full-touch LCD 30 shown in FIG. 47, the pop-up menu is activated and displayed as shown in FIG. 49.

FIG. 49 is a diagram showing a screen to select a stain category in a full-touch LCD according to an embodiment of the present disclosure.

In FIG. 49, the full-touch LCD 30 displays a pop-up menu including beverage, Sauce, Ink, Ice cream and vegetables through the field "Stain Category" and displays a pop-up menu including Coffee, Red Wine, orange juice, Apple and Blueberry through the field "Stain".

Accordingly, the user touches the activated pop-up menu so as to select a stain category.

When the user selects a fabric kind and a stain category through the above process and then touches a button "View Stain Guide Tip" provided on the lower end of the right side of the screen, the full-touch LCD 30 displays guide information to remove stains from laundry as shown in FIG. 50.

FIG. 50 is a diagram showing a guide screen to remove stains from laundry in a full-touch LCD according to an embodiment of the present disclosure.

In FIG. 50, the full-touch LCD 300 displays laundry stain removal tips and a recommended wash program of the washing machine 1.

At this time, the full-touch LCD 30 may search user postscripts through a Social Network Service (SNS) such as Twitter, search folk remedies provided by Twitter, and select a desired recommended wash program. That is, the full-touch LCD 30 may receive guide information to remove stains from laundry over a network.

Figure 51:
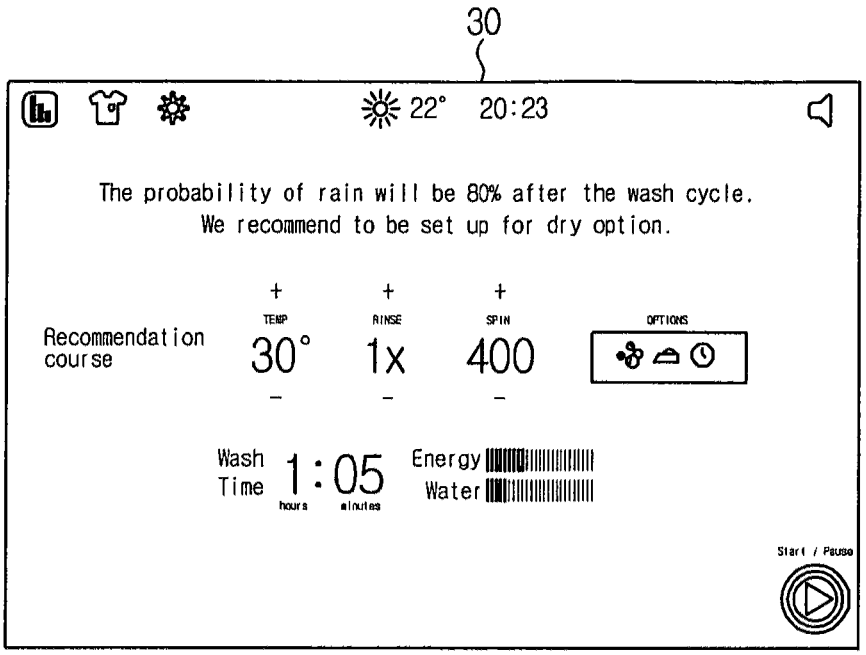
FIG. 51 is a diagram showing wash information of a recommended wash program in a full-touch LCD according to an embodiment of the present disclosure.

In FIG. 50, when the user touches a button "Start washing" in order to remove stains from laundry using a recommended wash program, the full-touch LCD 30 displays wash information of the recommended wash program as shown in FIG. 51.

FIG. 51 is a diagram showing wash information of a recommended wash program in a full-touch LCD according to an embodiment of the present disclosure.

In FIG. 51, the full-touch LCD 30 displays a wash option (e.g., a dry course) to be added to the displayed recommended wash program in consideration of weather information (e.g., The probability of rain will be 80% after the wash cycle) through a message.

Accordingly, the user may receive weather information after the wash cycle in addition to the recommended wash program to remove stains from laundry and add a wash option suiting the weather information, which will be described with reference to FIG. 52.

Figure 52:
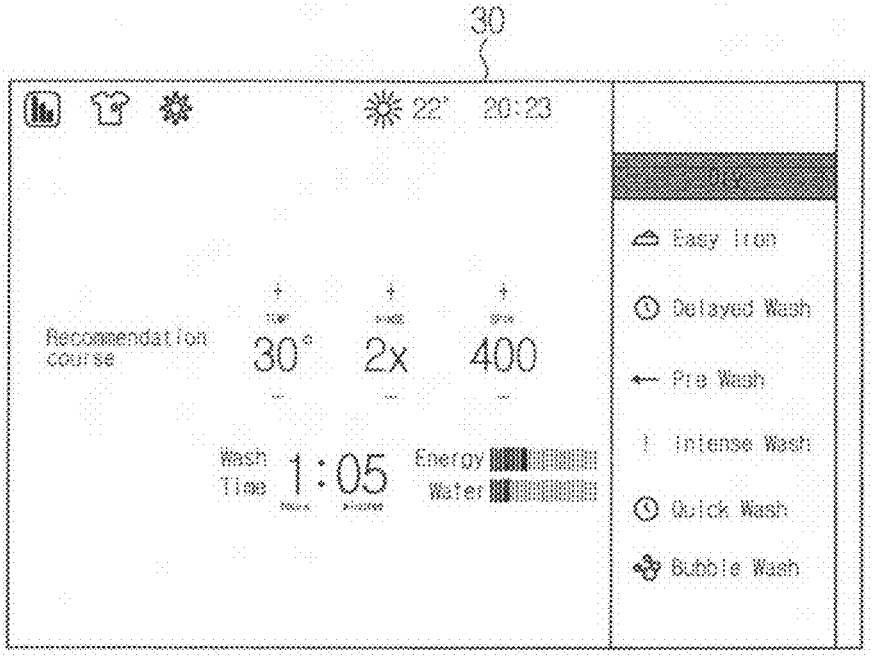
FIG. 52 is a diagram showing dry option addition information in a full-touch LCD according to an embodiment of the present disclosure.

FIG. 52 is a diagram showing dry option addition information in a full-touch LCD according to an embodiment of the present disclosure.

In FIG. 52, when the user selects a dry option function through touch input, the full-touch LCD 30 may display an animated screen depicting wind blowing to indicate drying.

Figure 53:
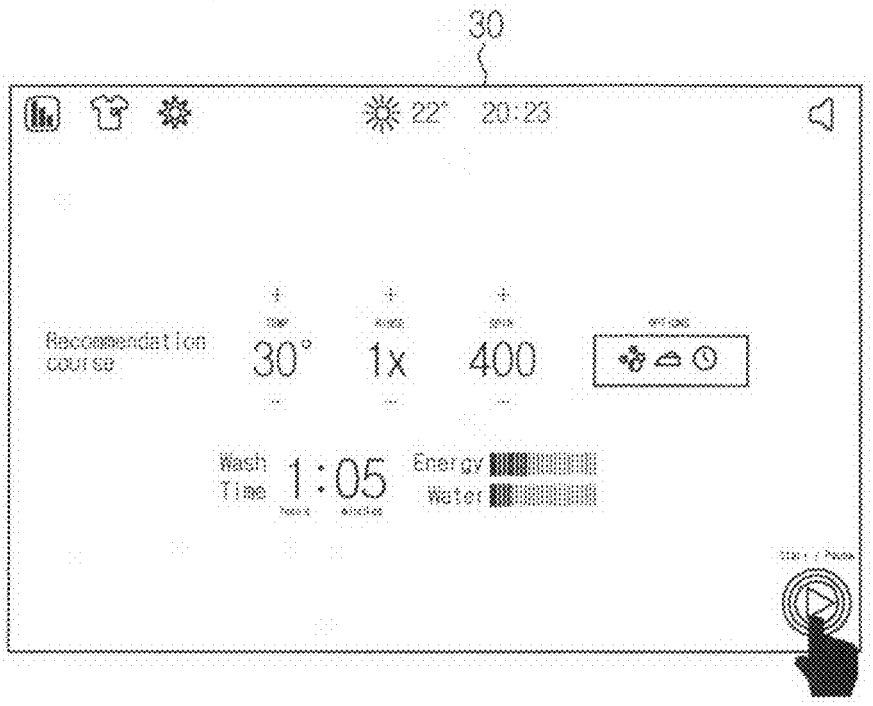
FIG. 53 is a diagram showing a wash program to remove stains from laundry in a full-touch LCD according to an embodiment of the present disclosure.

When all wash information to remove stains from laundry is selected through the processes of FIGS. 47 to 52, the full-touch LCD 30 displays final information of the selected wash program as shown in FIG. 53.

FIG. 53 is a diagram showing a wash program to remove stains from laundry in a full-touch LCD according to an embodiment of the present disclosure.

Figure 54:
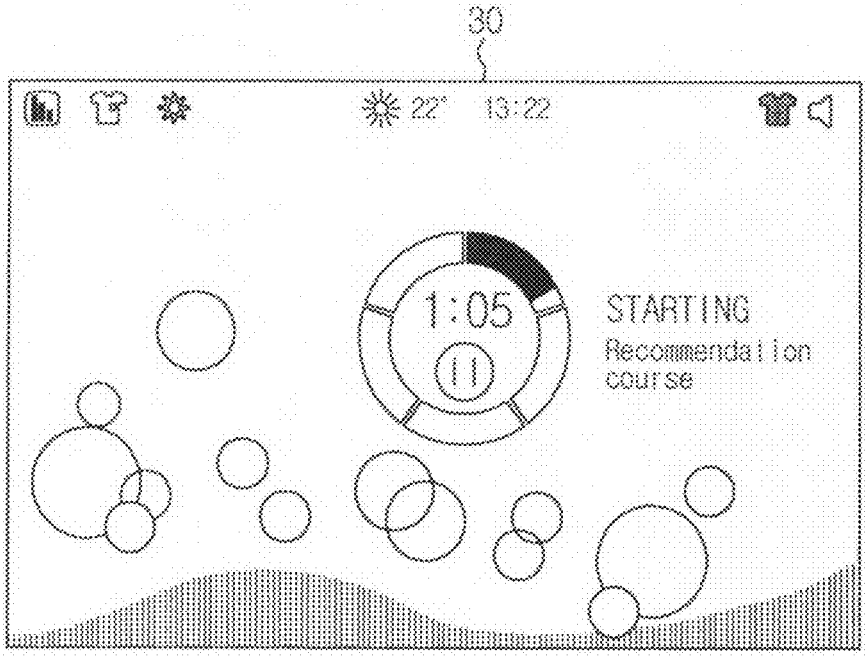
FIG. 54 is a diagram showing a wash progress state to remove stains from laundry in a full-touch LCD according to an embodiment of the present disclosure.

In FIG. 53, when the user touches a "Start/Pause" key provided on the lower end of the right side of the full-touch LCD 30, the full-touch LCD 30 displays the progress state of the wash program to remove stains from laundry as shown in FIG. 54.

FIG. 54 is a diagram showing a wash progress state to remove stains from laundry in a full-touch LCD according to an embodiment of the present disclosure.

Figure 55:
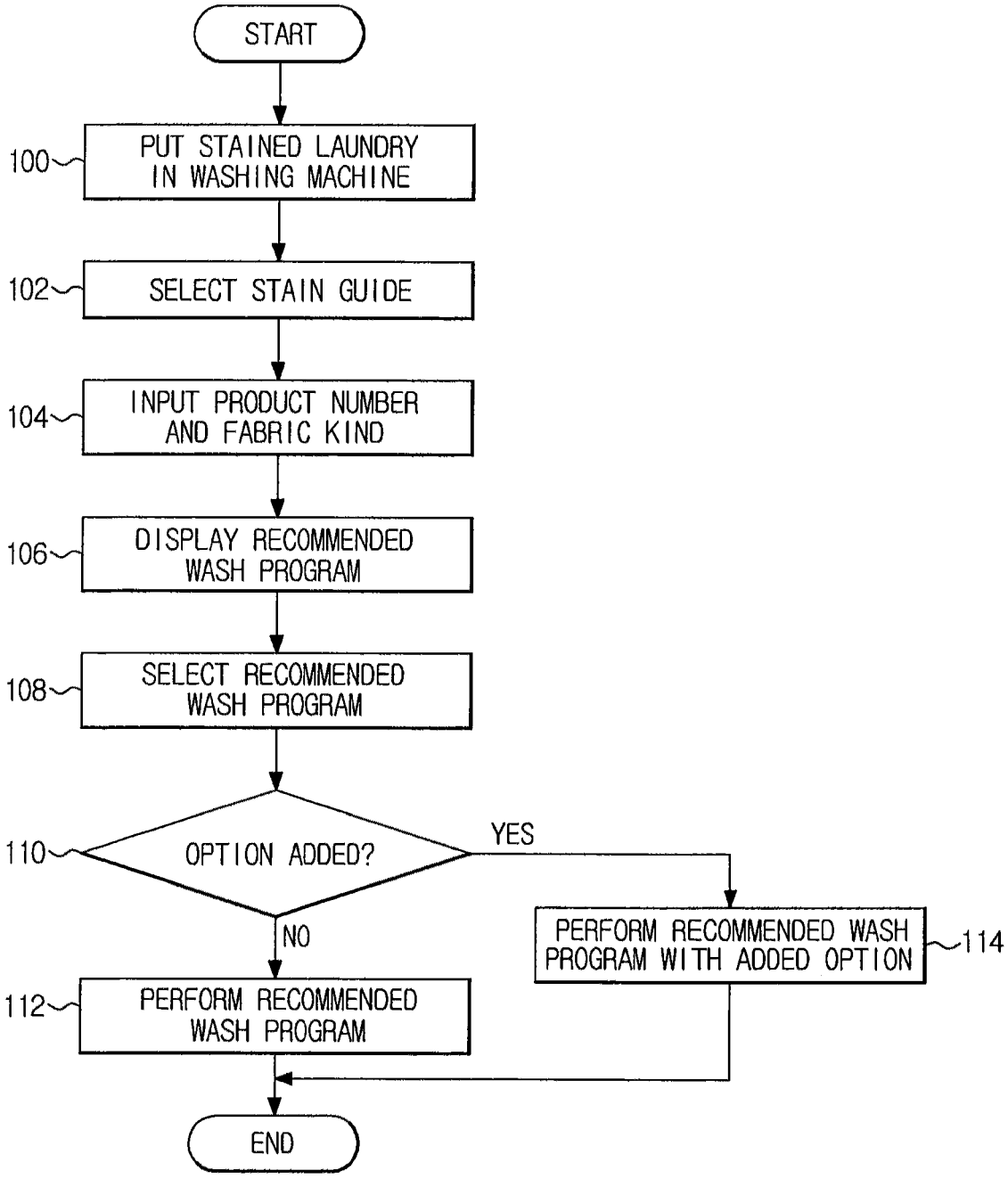
FIG. 55 is a flowchart illustrating a process of performing a wash program to remove stains from laundry in a full-touch LCD according to an embodiment of the present disclosure.

The process of performing the wash program to remove stains from laundry described through FIGS. 47 to 54 is summarized in FIG. 55.

FIG. 55 is a flowchart illustrating a process of performing a wash program to remove stains from laundry in a full-touch LCD according to an embodiment of the present disclosure.

In FIG. 55, when laundry is stained with ink, the user opens a door 20 and puts the laundry stained with ink in the washing machine 1 (100).

Thereafter, when the user selects stain guide using the full-touch LCD 30 (102), a stain guide screen shown in FIG. 47 is displayed.

Accordingly, the user touches the field "Fabric" on the stain guide screen shown in FIG. 47 so as to select a fabric kind, touches the field "Stain Category" and the field "Stain" so as to select a stain category, and touches the button "View Stain Guide Tip" provided on the lower end of the right side of the screen, thereby receiving guide information to remove stains from laundry.

When the user inputs a product number and a fabric kind through the stain guide, a stain treatment method provided by a manufacturer may be displayed (104).

Thereafter, the full-touch LCD 30 displays a wash program recommended by the manufacturer (106). Then, when the user selects the recommended wash program (108), weather information after the wash cycle is checked and a determination as to whether a wash option is added is made (110).

If it is determined that a wash option is added in Operation 110 (YES), a cycle to remove stains from laundry using the recommended wash program with the added option function begins (114).

If it is determined that a wash option is not added in Operation 110 (NO), a cycle to remove stains from laundry using the recommended wash program begins (112).

In the process of performing the wash program to remove stains from laundry, the user may put the stained laundry in the washing machine 1 and determine whether or not a delayed time is selected. The method to select the delayed time is described with reference to FIGS. 10 and 11.

The full-touch LCD 30 according to the embodiment of the present disclosure recommends a wash program according to real-time weather using the Android operation system (OS), which will be described with reference to FIGS. 56 and 57.

Figure 56:
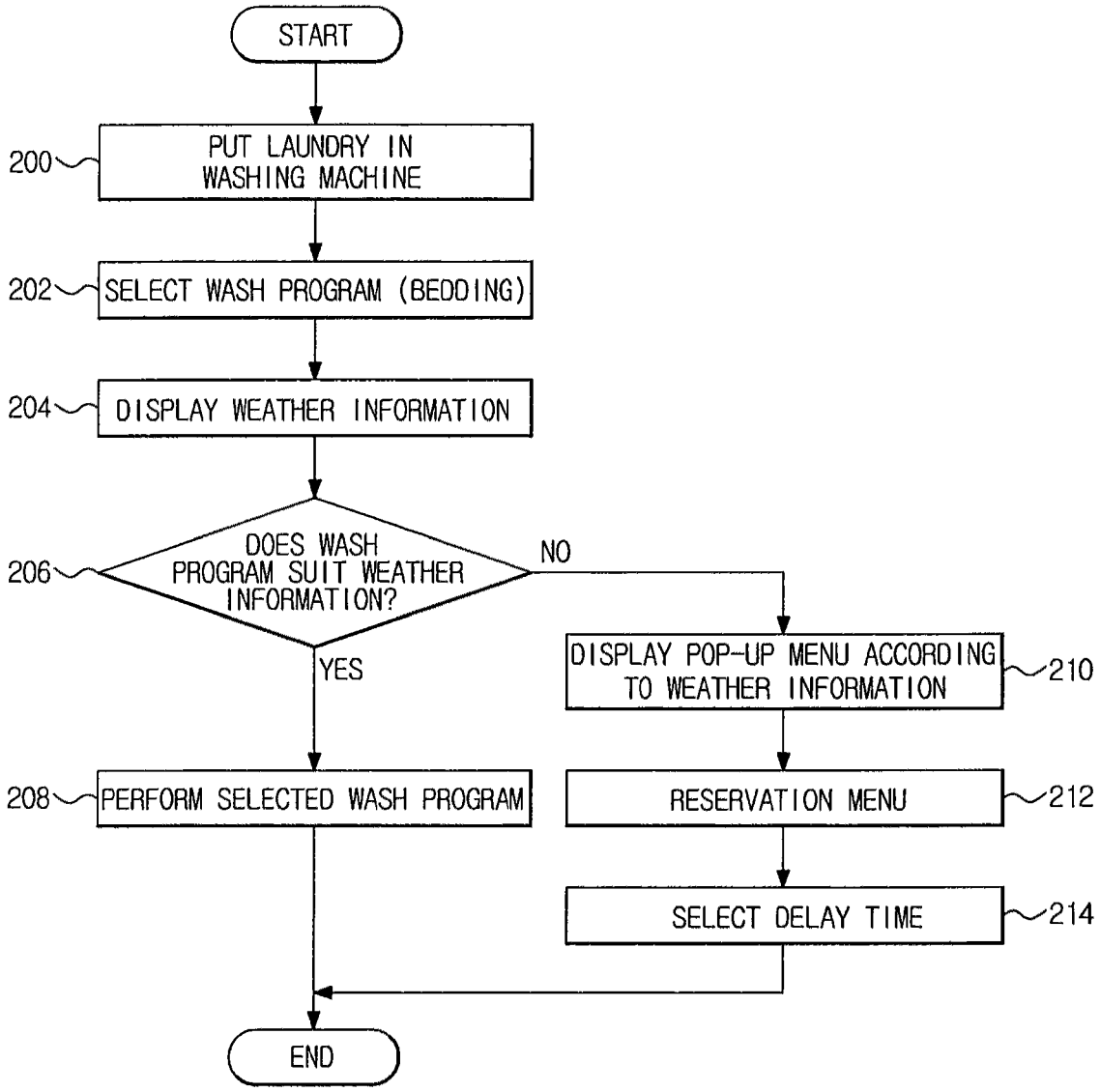
FIG. 56 is a flowchart illustrating a process of recommending a wash program according to weather in a full-touch LCD according to an embodiment of the present disclosure.
Figure 57:
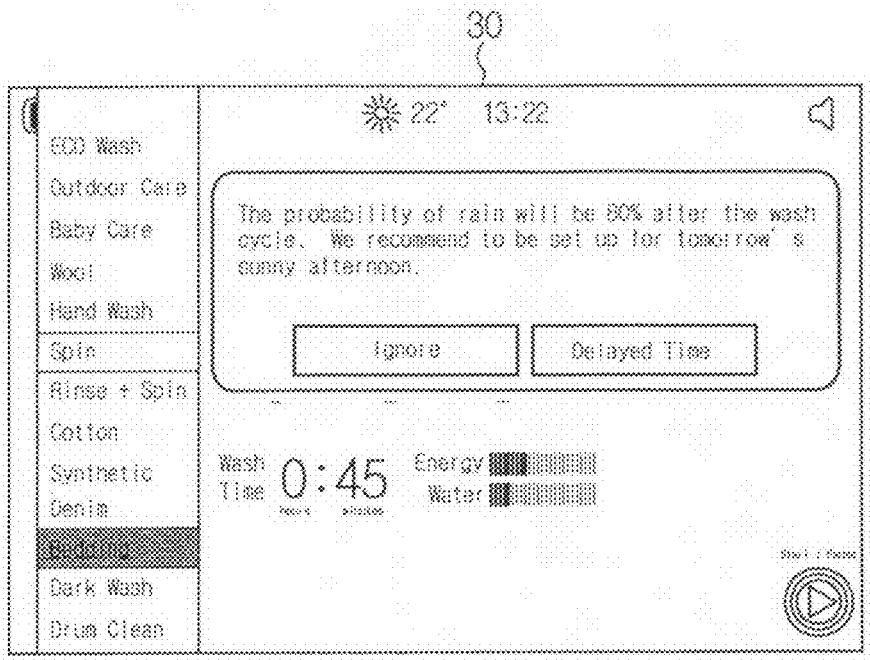
FIG. 57 is a diagram showing a screen to recommend a wash program according to weather in a full-touch LCD according to an embodiment of the present disclosure.

FIG. 56 is a flowchart illustrating a process of recommending a wash program according to weather in a full-touch LCD according to an embodiment of the present disclosure, and FIG. 57 is a diagram showing a screen to recommend a wash program according to weather in a full-touch LCD according to an embodiment of the present disclosure.

In FIG. 56, when the user opens the door 20, puts bedding in the washing machine 1 (200) and selects a wash program (Bedding) (202), weather information "rainy after sunny" is displayed on the full-touch LCD 30 (204).

Accordingly, the washing machine 1 determines whether or not the wash program (Bedding) is selected to suit the weather information (YES), the selected wash program (Bedding) begins (208).

If the wash program (Bedding) does not suit the weather information in Operation 206 (NO), the full-touch LCD 30 displays a pop-up menu "The probability of rain will be 80% after the wash cycle. We recommend to be set up for tomorrow's sunny afternoon" according to the weather information as shown in FIG. 57 (210).

Accordingly, the user ignores this pop-up menu and performs the wash cycle or puts bedding in the washing machine 1 and sets the delayed time to tomorrow afternoon.

In FIG. 57, when the user ignores the pop-up menu and touches a key "ignore", the selected wash program begins (208).

In FIG. 57, when the user wishes to wash bedding tomorrow according to the pop-up menu, the user selects a delayed time to tomorrow afternoon using a reservation menu (212 and 214). The method to select the delayed time is described with reference to FIGS. 10 and 11.

The full-touch LCD 30 according to the embodiment of the present disclosure displays a process of saving and donating energy using a smart grid function, which will be described with reference to FIGS. 58 to 64.

Figure 58:
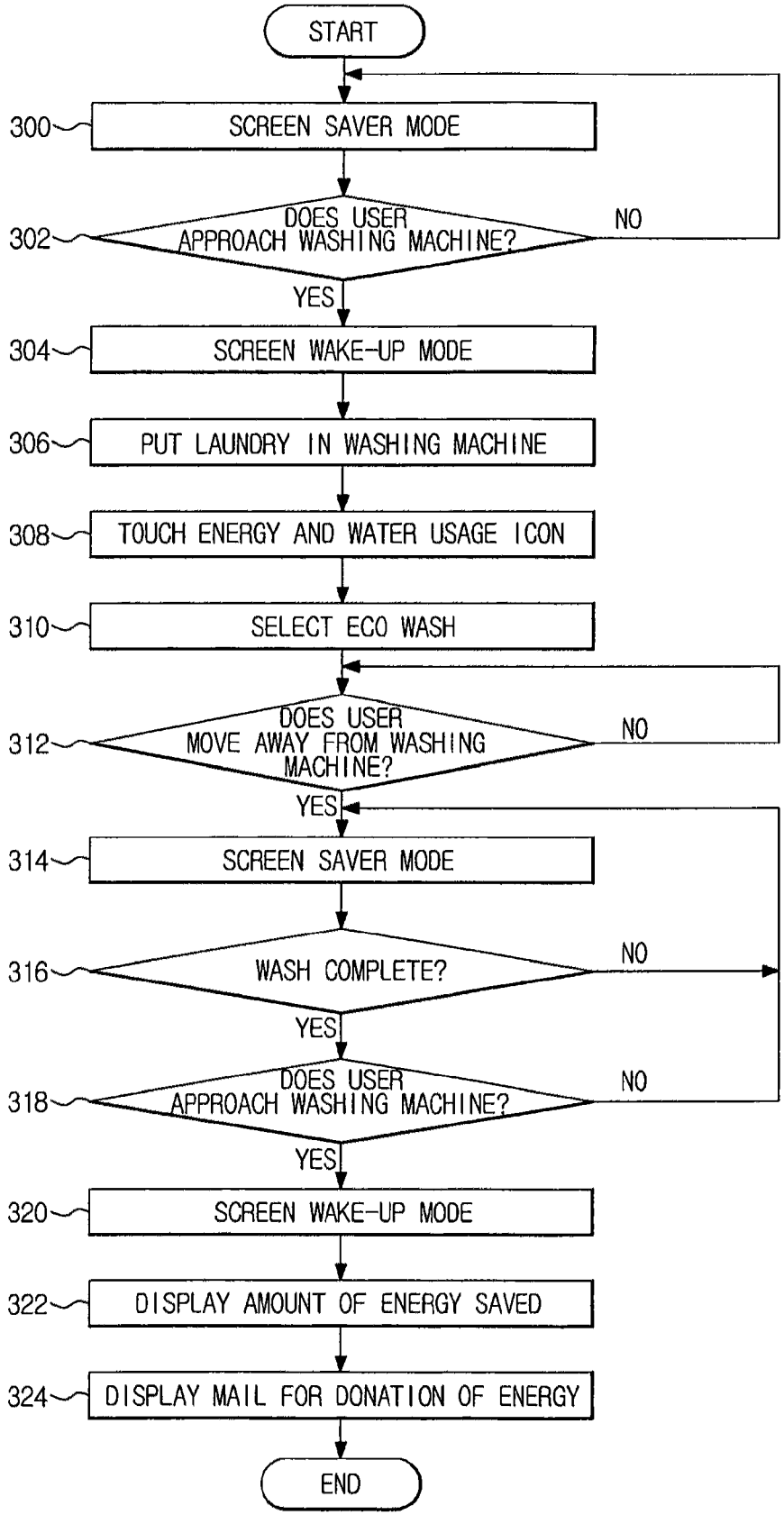
FIG. 58 is a flowchart illustrating a process of donating energy in a full-touch LCD according to an embodiment of the present disclosure.
Figure 59:
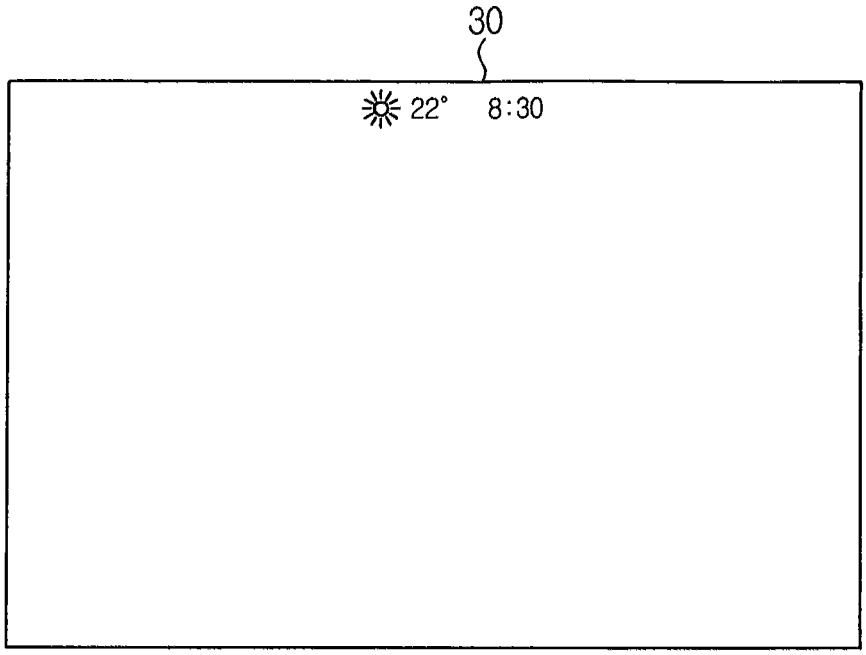
FIG. 59 is a second diagram showing a screen saver state of a full-touch LCD according to an embodiment of the present disclosure.
Figure 60:
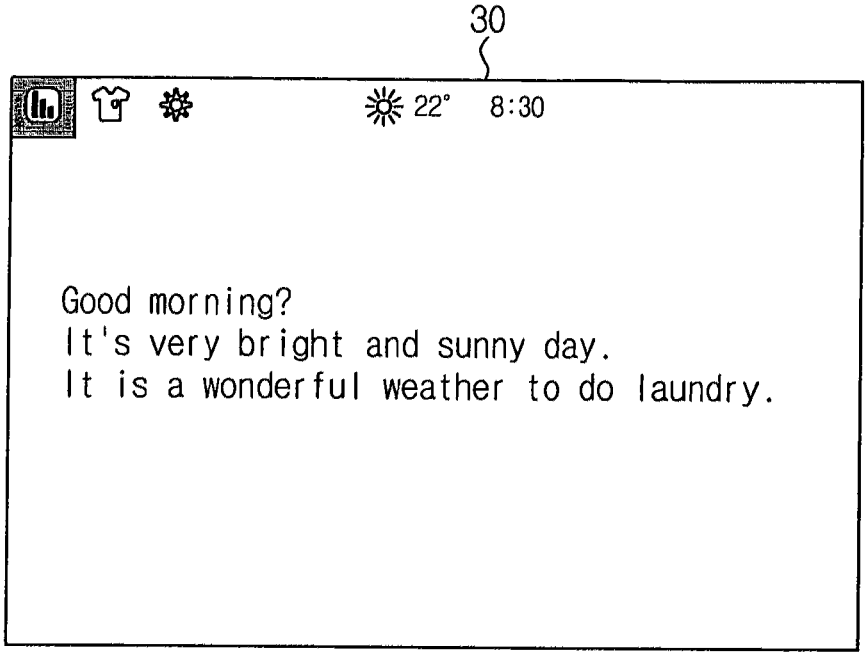
FIG. 60 is a diagram showing a state of displaying weather information in a full-touch LCD according to an embodiment of the present disclosure.

FIG. 58 is a flowchart illustrating a process of donating energy in a full-touch LCD according to an embodiment of the present disclosure, FIG. 59 is a second diagram showing a screen saver state of a full-touch LCD according to an embodiment of the present disclosure, and FIG. 60 is a diagram showing a state of displaying weather information in a full-touch LCD according to an embodiment of the present disclosure.

In FIG. 58, the full-touch LCD 30 operates in a screen saver mode to display only a weather icon and a time as shown in FIG. 59 (300).

At this time, when the user holding laundry approaches the washing machine 1 (302), the full-touch LCD 30 displays a message "Good morning" and real-time weather information as text while the screen saver screen of FIG. 59 is switched to a wake-up mode (304).

Only the weather icon and the time are displayed in the screen saver mode of FIG. 59 and a pleasant background and a dialogue message are displayed in the wake-up mode of FIG. 60.

Figure 61:
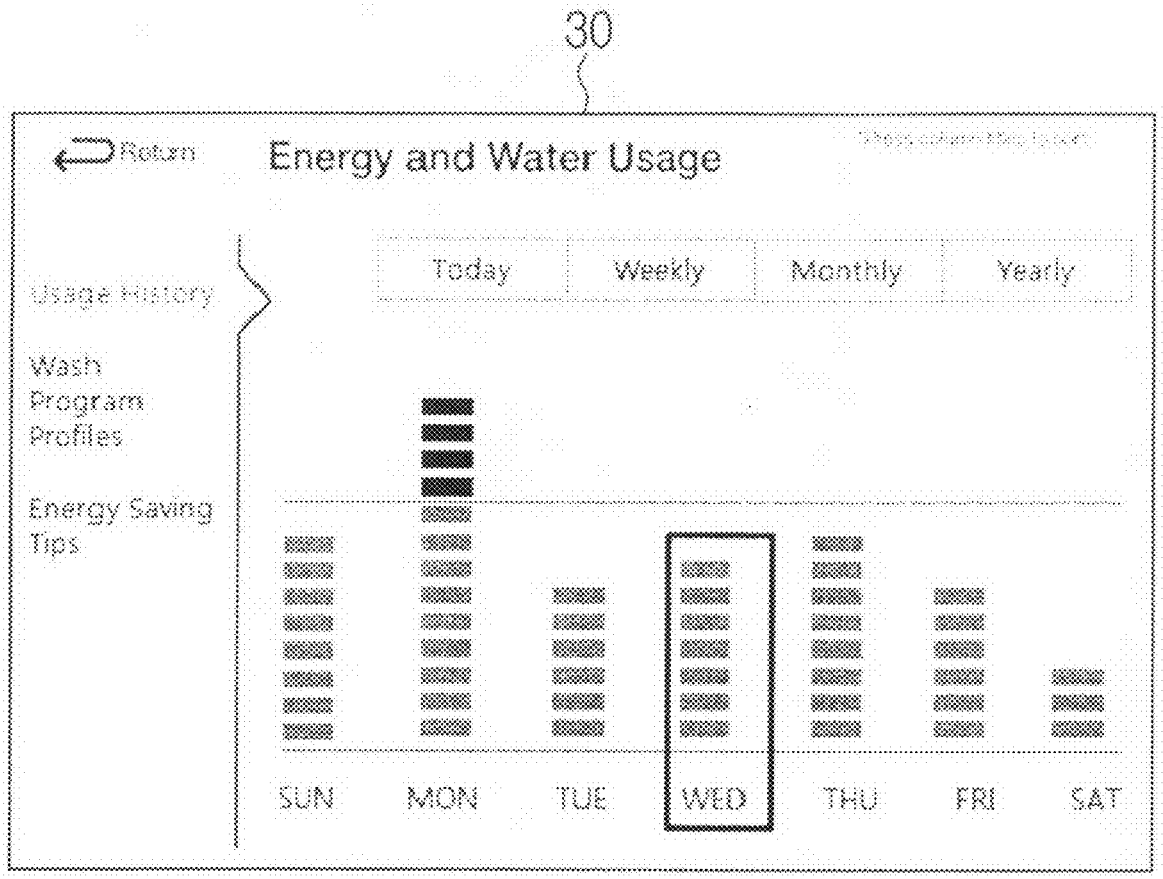
FIG. 61 is a diagram showing an energy and water usage history screen in a full-touch LCD according to an embodiment of the present disclosure.

Thereafter, when the user opens the door 20, puts laundry in the washing machine 1 (306) and touches the energy and water usage icon provided on the upper end of the left side of the wake-up mode screen of FIG. 60 (308), the full-touch LCD 30 displays the energy and water usage history screen as shown in FIG. 61 such that the user checks a weekly wash program and a weekly energy and water usage history and saves and donates energy using the "smart grid" function.

FIG. 61 is a diagram showing an energy and water usage history screen in a full-touch LCD according to an embodiment of the present disclosure.

In FIG. 61, the energy and water usage history is displayed in a weekly unit as default and a today's energy and water usage history has a color different from that of the other days of the week, thereby enabling the user to easily confirm the that day's energy and water usage history.

Figure 62:
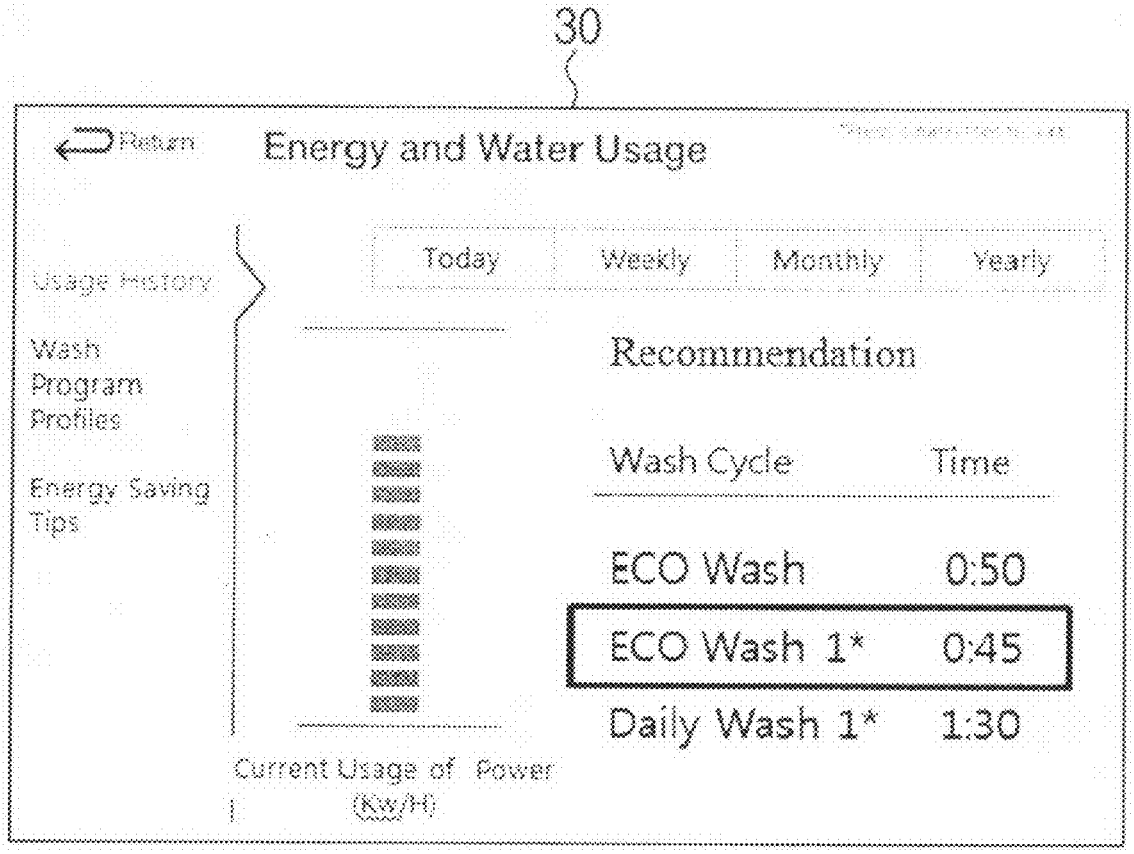
FIG. 62 is a diagram showing a list of recommended wash programs in a full-touch LCD according to an embodiment of the present disclosure.

When the user touches "Today" or a day of the week on the energy and water usage history screen shown in FIG. 61, the full-touch LCD 30 displays a list of recommended wash programs as shown in FIG. 62.

FIG. 62 is a diagram showing a list of recommended wash programs in a full-touch LCD according to an embodiment of the present disclosure.

In FIG. 62, the full-touch LCD 30 displays current usage of power in the form of a gauge and provides a list of recommended courses and time information tips.

For example, a message indicating that much power is consumed today is displayed and current power consumption and a selectable wash program are displayed as a pop-up menu. Accordingly, the user selects "ECO Wash course (e.g., ECO Wash 1*)" from among the wash programs displayed in the pop-up menu (310).

When the user selects "ECO Wash course (e.g., ECO Wash 1*)", the wash cycle begins according to the selected wash program (ECO Wash 1*) and the full-touch LCD 30 operates in the screen saver mode after a predetermined time as shown in FIG. 59 (314) if the user moves away from the washing machine in Operation 312 (YES). If the user does not move away from the washing machine in Operation 312 (NO), the current power consumption and selected wash program continue to be displayed.

Thereafter, if the selected wash program is completed (316), sound is output through the sound output unit 54 so as to inform the user that the wash cycle is completed.

Accordingly, when the user hears the sound indicating that the wash cycle is completed and approaches the washing machine 1 (318), the full-touch LCD 30 is switched to the wake-up mode again. The full-touch LCD 30 displays a reward screen to indicate how much energy is saved in the wash program (ECO Wash 1*) along with a message "Your washing is completed" as shown in FIG. 63 (320).

Figure 63:
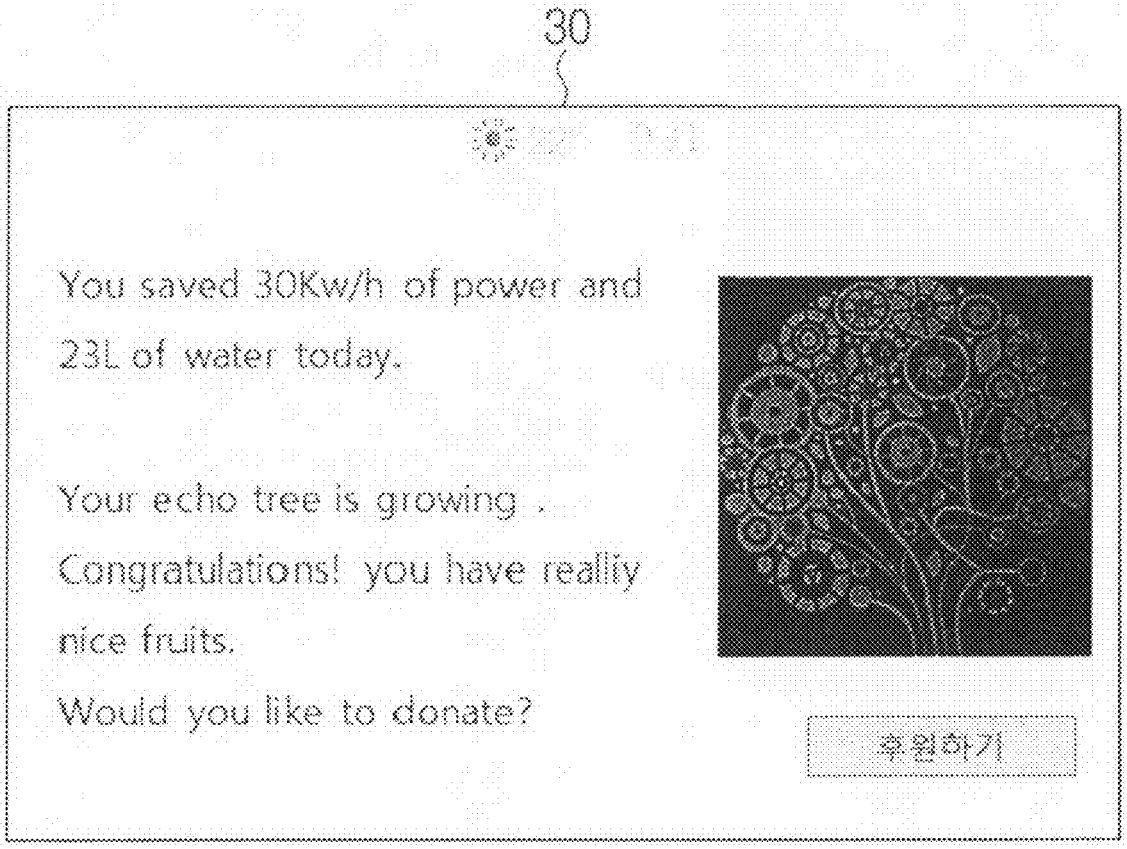
FIG. 63 is a diagram showing a reward screen of energy saved by the recommended wash program of FIG. 62.

FIG. 63 is a diagram showing a reward screen of energy saved by the recommended wash program of FIG. 62.

In FIG. 63, the full-touch LCD 30 displays a message indicating energy saved today and water usage and displays a tree which fruits using the saved energy (322).

Figure 64:
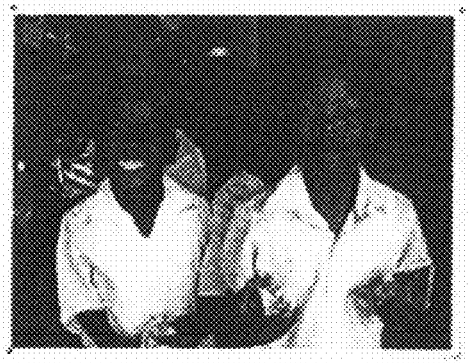
FIG. 64 is a diagram showing a screen showing an email for donation of energy saved by the recommended wash program of FIG. 62.

Accordingly, when the user donates the displayed fruits to a donation site in FIG. 63, the full-touch LCD 30 displays a bright face and a reply of a child who receives the donated fruits through an email as shown in FIG. 64 (324).

FIG. 64 is a diagram showing a screen showing an email for donation of energy saved by the recommended wash program of FIG. 62.

Through such a process, the user may donate the saved energy.

The full-touch LCD 30 according to the embodiment of the present disclosure displays real-time weather information using the Android™ operating system (OS), which will be described with reference to FIG. 65.

Figure 65:
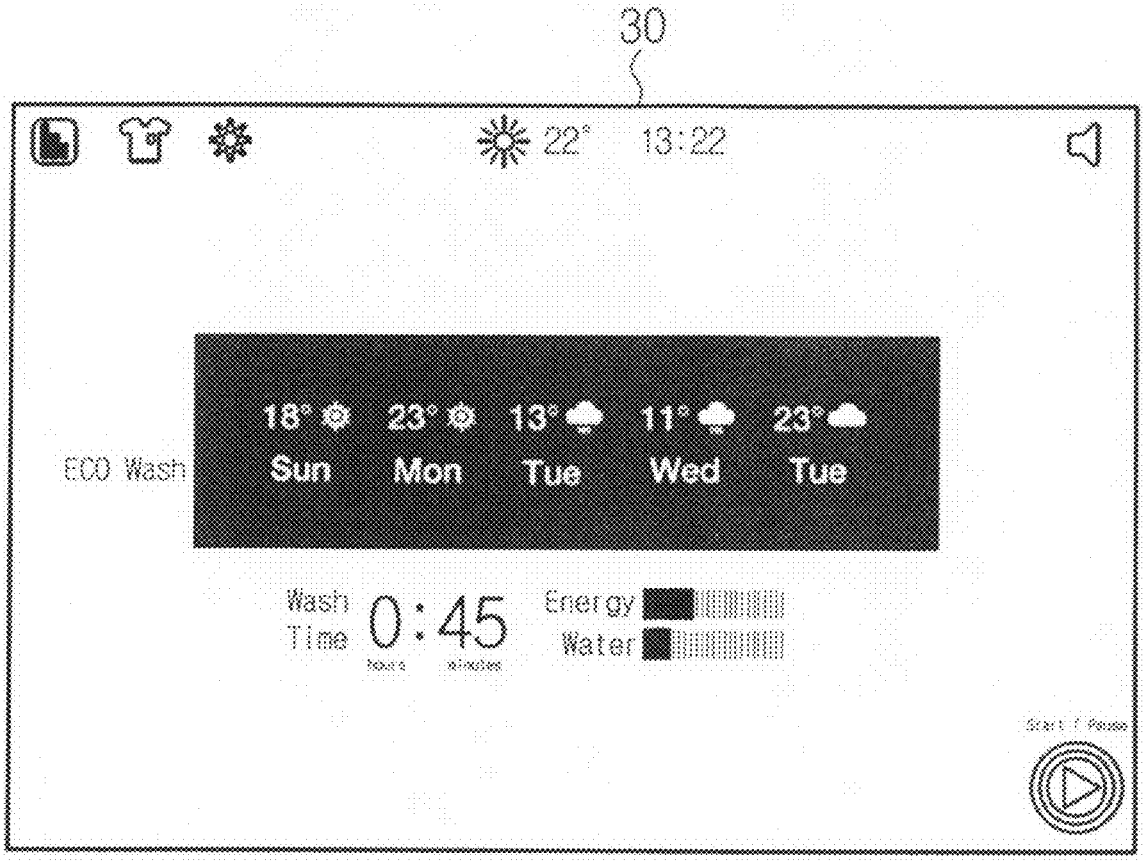
FIG. 65 is a diagram showing a state of displaying real-time weather information of a full-touch LCD according to an embodiment of the present disclosure.

In FIG. 65, when the user touches a weather area, the color of the weather screen is changed according to the color of the background screen.

In addition, the full-touch LCD 30 applies three colors such as Blue, Green and Red according to energy used in the wash program when the wash program is changed and provides a display screen using a color value set according to energy usage and water temperature.

For example, when a wash program "Hand Wash" is selected, the background screen is blue and Daily Wash is 40° C. (default screen), Outdoor care is 30° C., Wool/Synthetics is 40° C., Hand Wash is 30° C., Denim is 30° C. and Dark Garment is 40° C.

When a wash program "Eco Wash" is selected, the background screen is green and Eco Drum Clean is 70° C. (0.53 kwh).

When wash programs "Baby care (95° C.)" and "Cotton (60° C.)" are selected, the background screen is red.

The full-touch LCD 30 displays the background screen, the color of which is gradated according to a temperature changed while the wash program is performed.

According to the washing machine and the method of controlling the same according to the embodiments of the present disclosure, it is possible to provide a user interface by simple and convenient touch manipulation and display information regarding a user manipulation state and an operation state of the washing machine according to various visual/tactile tastes.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A method of controlling a washing machine including a full-touch Liquid Crystal Display (LCD) to perform communication over a network, the method comprising:

displaying real-time weather information by performing communication over the network;

recommending a wash program according to the real-time weather information;

displaying basic wash information and energy usage of the wash program;

changing a color of a display screen according to the energy usage of the wash program;

displaying a progress state of the wash program according to user touch input, gradating the color of the display screen according to the energy usage while the wash program is performed;

displaying an energy and water usage history;

recommending a wash program according to the energy and water usage history; and displaying the amount of energy and water saved after performing the wash program recommended according to the energy and water usage history, wherein the method further comprises operating the full-touch LCD in a screen saver mode depending on whether or not a user approaches the washing machine;

wherein the basic wash information includes a washing water temperature, a rinse number, spin RPM information and wash time information of the wash program;

wherein a time and RPM of the wash program are changed according to the energy usage while the wash program is performed; and wherein the color includes blue, green and red.

2. The method according to claim 1, further comprising providing laundry stain removal information by performing communication over the network.

3. The method according to claim 2, wherein the providing the laundry stain removal information includes:

selecting laundry and a stain category; and displaying a recommended wash program according to the selected laundry and stain category.

4. The method according to claim 3, further comprising:

inputting a product number of the laundry; and displaying a stain treatment method recommended by a manufacturer by performing communication over the network.

5. A method of controlling a washing machine including a full-touch Liquid Crystal Display (LCD) to perform communication over a network, the method comprising:

selecting a wash program through user touch input;

displaying real-time weather information by performing communication over the network;

determining whether the selected wash program suits the real-time weather information;

performing the wash program if the selected wash program suits the real-time weather information;

displaying a progress state of the wash program;

gradating a color of a display screen according to energy usage of the wash program while the wash program is performed;

displaying a message recommending that the wash program be changed into a recommended weather-suited wash program depending on the selected wash program if the selected wash program does not suit the real-time weather information, displaying an energy and water usage history;

recommending a wash program according to the energy and water usage history;

displaying the amount of energy and water saved after performing the recommended wash program; and displaying wash options according to the real-time weather information, wherein the method further comprises operating the full-touch LCD in a screen saver mode depending on whether or not a user approaches the washing machine;

wherein the selecting the wash program includes scrolling through a menu of the wash program and searching wash programs, and touching and selecting a desired wash program from among the searched wash programs;

wherein when the menu of the wash program is scrolled, basic wash information and energy usage of the wash program are displayed;

wherein the wash program includes wash cycles of ECO to save energy consumption, Outdoor Care to wash outer garments, Baby Care to wash baby clothes, Wool to wash wool clothes, Hand Wash to provide a hand washing effect, Spin, Rinse+Spin, Cotton to wash cotton fabrics, Synthetics to wash synthetic fabrics, Denim to wash jeans, Bedding to wash bedding, Dark Garment to wash dark colored clothes, and Daily Wash to wash daily clothes;

wherein the wash options include wash cycles of Bubble Wash to perform washing by use of bubbles, Easy Iron to provide an ironing effect, Delayed Wash to reserve a washing time, Pre Wash, Intense Wash to perform powerful washing, Quick Wash to perform simplified washing, and Dry; and wherein when a dry option function is selected, an animated screen is displayed depicting wind blowing to indicate drying.

6. A washing machine comprising:

a full-touch Liquid Crystal Display (LCD) configured to operate in a screen saver mode depending on whether or not a user approaches the washing machine, and to display information regarding various states of the washing machine through user touch input;

a controller to control a wash program according to touch information input through the full-touch LCD;

a communication unit to perform network communication so as to display a variety of information associated with the wash program using the full-touch LCD; and a sensor to sense whether or not a user approaches the washing machine, wherein the full-touch LCD receives and displays real-time weather information using the communication unit, displays basic wash information and energy usage of the wash program, changes a color of a display screen according to the energy usage of the wash program, displays an energy and water usage history, displays a progress state of the wash program, and receives and displays laundry stain removal information through the communication unit;

wherein the controller operates the full-touch LCD according to information sensed by the sensor, recommends a wash program according to the real-time weather information and displays the wash program using the full-touch LCD, and recommends a wash program according to the energy and water usage history and displays the wash program using the full-touch LCD; and wherein the basic wash information includes a washing water temperature, a rinse number, spin RPM information and wash time information of the wash program.

7. The washing machine according to claim 6, further comprising a sound output unit to audibly output a progress state of the wash program.

* * * * *